US006069590A

United States Patent [19]

Thompson, Jr. et al.

[11] Patent Number: 6,069,590

[45] Date of Patent: May 30, 2000

[54] SYSTEM AND METHOD FOR INCREASING THE ISOLATION CHARACTERISTIC OF AN ANTENNA

[75] Inventors: James Ernest Thompson, Jr., Lilburn; Po Than, Auburn, both of Ga.

[73] Assignee: EMS Technologies, Inc., Norcross, Ga.

[21] Appl. No.: 09/026,665

[22] Filed: Feb. 20, 1998

[51] Int. Cl.[7] ..... H01Q 9/28; H01Q 21/26

[52] U.S. Cl. ..... 343/795; 343/797

[58] Field of Search ..... 343/795, 797, 343/872, 700 MS; H01Q 9/28, 21/26

[56] References Cited

U.S. PATENT DOCUMENTS

| | | | |
|---|---|---|---|
| 3,710,333 | 1/1973 | Crom | 343/114 |
| 5,047,787 | 9/1991 | Hogberg | 343/841 |
| 5,298,906 | 3/1994 | Lantagne et al. | 342/175 |
| 5,373,297 | 12/1994 | Briguglio | 342/15 |
| 5,481,272 | 1/1996 | Yarsunas | 343/795 |
| 5,771,024 | 6/1998 | Reece et al. | 343/795 |
| 5,818,397 | 10/1998 | Yarsunas et al. | 343/797 |
| 5,841,401 | 11/1998 | Bodley et al. | 343/872 |

FOREIGN PATENT DOCUMENTS

| | | |
|---|---|---|
| 0001883 | 5/1979 | European Pat. Off. . |
| 56-013812 | 2/1981 | Japan . |
| 59-194517 | 11/1984 | Japan . |
| WO 97/22159 | 6/1997 | WIPO . |

OTHER PUBLICATIONS

Teichman, M.A., "Designing Wire Grids for Impedance Matching of Dielectric Sheets", *The Microwave Journal*, Apr., 1968, pp. 73–78.

*Primary Examiner*—Don Wong
*Assistant Examiner*—Hoang Nguyen
*Attorney, Agent, or Firm*—King & Spalding

[57] ABSTRACT

An antenna having feedback elements for improving the isolation characteristic of the antenna by generating a feedback signal that operates to cancel an undesired leakage signal coupling from an input port to an output port of the antenna system. The antenna can include a distribution network for electrically coupling the electromagnetic signals from and to radiating elements and a radome structure for protecting both the radiating elements and the distribution network from exposure to the operating environment of the antenna. The radome structure can include feedback elements for electrically cooperating with the radiating elements of the antenna system. Electromagnetic signals transmitted by the radiating elements can be coupled to the feedback elements, which results in the feedback elements resonating at the frequency of the transmitted electromagnetic signals. These resonating feedback elements can generate a feedback signal that, in turn, is received by the radiating elements. The feedback signal, when combined with the undesired leakage signal at the output port, cancels both signals, thereby achieving an antenna system having an improved isolation.

35 Claims, 19 Drawing Sheets

SYSTEM AND METHOD FOR INCREASING THE ISOLATION CHARACTERISTIC OF AN ANTENNA

RELATED APPLICATIONS

This application is related to U.S. patent application Ser. No. 08/572,529, filed Dec. 14, 1995 and U.S. patent application Ser. No. 08/733,399, filed Oct. 18, 1996.

FIELD OF THE INVENTION

This invention relates to antennas for communicating electromagnetic signals and, more particularly, to improving sensitivity of an antenna by increasing the isolation characteristic of the antenna.

BACKGROUND OF THE INVENTION

Many types of antennas are in wide use today throughout the communications industry. Array antennas generally have a distribution network for electrically coupling electromagnetic signals to and from a radiating element to support transmitting and receiving operations. In particular, many of the antenna applications of today utilize dual polarized antenna designs. In dual polarized antenna designs, electrical isolation is generally defined as the isolation from a first port to a second port in the antenna system (i.e., the port-to-port isolation at the connectors). In contrast, dual polarized antennas also have radiation isolations defined in the far-field of the antenna which differ from port-to-port isolations defined at the antenna connectors. It is the problems associated with port-to-port isolations in the dual polarized antennas that we now direct our attention.

In describing port-to-port isolations in a dual polarized antenna system, it is typically best described in terms of Scattering Parameters (s-parameters). In applying a Scattering Parameter analysis, the dual polarized antenna system is generally treated as a two-port system. The first port (port 1) includes a signal going into port 1 (represented by "$a_1$") and a signal coming out of port 1 (represented by "$b_1$"). The second port (port 2) similarly includes a signal going into port 2 (represented by "$a_2$") and a signal coming out of port 2 (represented by "$b_2$"). With these representative signals, the Scattering Parameters can be determined so to completely characterize the two-port network. The set of Scattering Parameters for a two-port network includes the parameters $S_{11}$, $S_{12}$, $S_{21}$ and $S_{22}$. $S_{11}$ is determined from the ratio of "$b_1/a_1$", $S_{12}$ is determined from the ratio of "$b_1/a_2$", $S_{21}$ is determined from the ratio of "$b_2/a_1$" and $S_{22}$ is determined from the ratio of "$b_2/a_2$". Of these four parameters, the $S_{12}$ and $S_{21}$ parameters are considered when determining the port-to-port isolation in a dual polarized antenna. These two parameters characterize the signals passing from one port to another where $S_{12}$ represents a signal going from port two to port one and $S_{21}$ represents a signal going from port one to port two. Accordingly, in dual polarized antenna systems, the $S_{12}$ and $S_{21}$ parameters represent the leakage signals between ports one and two that may be present at the ports' connectors.

Poor sensitivity in dual polarized antennas can therefore result when part of an input (i.e., transmit) signal at the input port (port one) leaks or is otherwise coupled as a leakage signal to the output port (port two) and combines with a desired received signal at port two. When isolation is minimal, the antenna system will perform poorly in that the reception of incoming signals will be limited only to the strongest incoming signals due to the presence of leakage signals interfering with the weaker desired signals. Consequently, dual polarized antenna system performance can often be dictated by the isolation characteristic of the system.

One known technique for designing dual polarized antennas having a favorable isolation characteristic is by incorporating proper impedance matching within the distribution network. Impedance matching has been used to minimize the amount of impedance mismatch that a signal may experience when passing through the distribution network. In general, when impedance mismatches are present in an antenna system, part of an incoming signal will be reflected back and not passed through the area of impedance mismatch. When a signal is reflected from an area of impedance mismatch in a dual polarized antenna system that is designed for both transmitting and receiving electromagnetic signals, the reflected signal can result in a leakage signal that accesses the output port (port 2) where received signals are present. The presence of this leakage signal at the output port causes a significant degradation in the overall isolation characteristic and performance of the dual polarized antenna system. Impedance mismatch can cause these leakage signals to occur, and degrade the port-to-port isolation, if (1) a cross-coupling mechanism is present within the distribution network or radiating elements (2) reflecting features are present beyond the radiating elements. Proper impedance matching can result in an increased isolation characteristic for a dual polarized antenna, but impedance matching still falls short of achieving the necessary degree of isolation that is now being required in the wireless communications industry.

Another technique for designing an antenna having an increased isolation characteristic is spacing the individual radiating elements sufficiently apart in an antenna array. However, the area and dimensional constraints placed on the antenna designs of today generally renders the physical separation technique impractical in all but a few instances for wireless communications applications.

Other techniques for improving the isolation characteristic of an antenna, particularly a dual polarized antenna, are to place a physical wall between each of the radiating elements or to use coaxial cable (i.e., shielded cable) to feed signals to and from the antenna system. Alternatively, the ground plane of the dual polarized antenna system can be modified so that the input and output ports (ports 1 and 2 respectively) do not share the same ground plane. That is, the ground plane associated with each of the input and output ports is separated by either a physical space or a non-conductive obstruction which serves to alleviate possible leakage of an input signal by coupling via the ground plane to the output port. However, none of these techniques lead to a significant improvement in the isolation characteristics typically exhibited in the antenna designs of today, and particularly dual polarized antenna designs.

Notwithstanding the above discussed techniques, none are capable of providing the high degree of isolation that is specified in certain wireless communications applications that require high reception sensitivities in dual polarized antennas. Consequently, there is a need for a technique that facilitates the design of a dual polarized antenna system having a high degree of isolation between the respective input and output ports. This high degree of isolation is particularly required for antennas used in the wireless communications industry, such as Personal Communications Services (PCS) and Cellular Mobile Radiotelephone (CMR) service.

SUMMARY OF THE PRESENT INVENTION

The present invention is useful for improving the performance of an antenna by increasing the port-to-port isolation characteristic of the antenna as measured at the port connectors. In general, the present invention achieves this improvement in sensitivity by using a feedback system comprising one or more feedback elements for generating a feedback signal in response to a transmitted signal output by each radiator of the dual polarized antenna. This feedback signal is received by each radiator, also described as a radiating element, and combined with any leakage signal present at the output port of the antenna. Because the feedback signal and the leakage signal are set to the same frequency and are approximately 180 degrees out of phase, this signal summing operation serves to cancel both signals at the output port, thereby improving the port-to-port isolation characteristic of the antenna.

More particularly, the antenna system typically comprises a distribution network having input and output ports (ports 1 and 2 respectively) for carrying signals to and from the antenna, and one or more radiating elements coupled to the distribution network for communicating electromagnetic signals. For example, in a dual polarized antenna system, a feedback system can be used to present a feedback signal to the radiating elements, which results in the cancellation of leakage signals "leaking" from port 1 (input port) to port 2 (output port) of the distribution network. The feedback system can generate the feedback signal in response to transmitted signals output by the radiating elements, which cause the feedback system to resonate at a frequency defined by the transmitted signals. For a dual polarized antenna comprising an array of radiating elements, the feedback system can include multiple feedback elements, each capable of generating a feedback signal in response to transmitted signals output by the radiating elements. This feedback signal is coupled to the radiating elements because the feedback system is typically placed proximate to the radiating elements within the structure of the dual polarized antenna system. In turn, the feedback signal is passed by the radiating elements to port 2 of the dual polarized antenna, where the feedback signal is summed with any leakage signal also present at port 2. Because the feedback signal is typically out-of-phase with the leakage signal, this signal summing operation leads to the cancellation of both signals. Significantly, this cancellation of leakage signal at port 2 results in an increase in the dual polarized antenna's port-to-port isolation at the connectors.

A radome is often used to protect the distribution network and the radiating elements from the harmful effects arising from exposure to the operating environment of the dual polarized antenna. Each feedback element can comprise a strip of conductive material coupled to the radome, typically connected to the interior surface, and positioned so to electrically cooperate with the radiating elements. Specifically, a feedback element can be placed proximate to a radiating element to incite the coupling of signals between the feedback element and the radiating element. For example, the feedback element can generate a feedback signal in response to a signal transmitted by the radiating element. This feedback signal is generated as a result of the feedback element resonating in response to the transmitted signal and, consequently, the feedback signal comprises frequency components similar to the transmitted signal. In turn, the feedback signal is coupled to the radiating element, which results in a cancellation of any leakage signals that may be present at port 2 due to the phase differences between the signals. In this manner, the port-to-port isolation characteristic of the dual polarized antenna system is increased which, in turn, facilitates an overall increase in the sensitivity of the dual polarized antenna system.

The characteristics of the feedback signal, including amplitude and phase, can be adjusted by varying the position of the feedback element relative to the radiating element thereby affecting the amount of coupling therebetween and, hence, the amount of port-to-port isolation. The feedback signal can be further adjusted by placing additional feedback elements into the dual polarized antenna system until a specific amount of feedback coupling is produced so to enable the cancellation of any leakage signals passing from port 1 to port 2.

For another aspect of the present invention, the feedback element can be capacitively coupled to the radiating element. For example, if the radiating element comprises a crossed pair of dipoles, the feedback element can be coupled to the substrate of each of the pair of dipoles, i.e., on the substrate opposite the dipole arms. Capacitively coupling the feedback element to a radiating element supports increased coupling of the feedback signal on a per individual feedback element basis. In comparison to the technique of placing feedback elements on the radome of the antenna, the capacitive coupling technique typically requires a smaller number of feedback elements in total to achieve the desired amount of port-to-port isolation in the antenna system.

For yet another aspect of the present invention, the feedback element can be implemented as a feedback post operatively coupled to a ground plane structure and positioned adjacent the radiating elements. For the representative example of a radiating element comprising a crossed pair of dipoles, the feedback post is typically positioned between the dipoles to support the coupling of electromagnetic signals between the radiating element and the feedback post. Because the feedback post can resonate at the same frequency of a signal transmitted by the radiating element, the feedback post can couple a feedback signal back into the radiating element resulting in a cancellation of leakage signals "leaking" from port 1 and present at port 2. Similar to the feedback post, a feedback wire can also be positioned on a nonconductive material, such as a foam block, and placed proximate to the radiating element. The feedback wire may take the form of various configurations, one such example being in the form of a loop. Still further, the feedback element can also be in the form of a conductive strip placed on a foam bar positioned between the radiating elements to obtain similar results. The use of the foam bar with the conductive strip results in placing the feedback element below the interior surface of the radome. It is further noted that the feedback elements may be positioned in a variety of configurations with equal success, such as non-uniform feedback element spacing (non-symmetrical patterns), and tilted feedback elements (introducing a rotational angle). It is further noted that the conductive element may be in varying forms, for example, the elements may be in the form of strips as well as circular patches.

In view of the foregoing, it can be readily appreciated that the present invention provides for the design and tuning of a dual polarized antenna system having a high port-to-port isolation characteristic thereby overcoming the sensitivity problems associated with prior antenna designs. Other features and advantages of the present invention will become apparent upon reading the following specification, when taken in conjunction with the drawings and the appended claims.

DETAILED DESCRIPTION OF EXEMPLARY EMBODIMENTS

Figure 1:
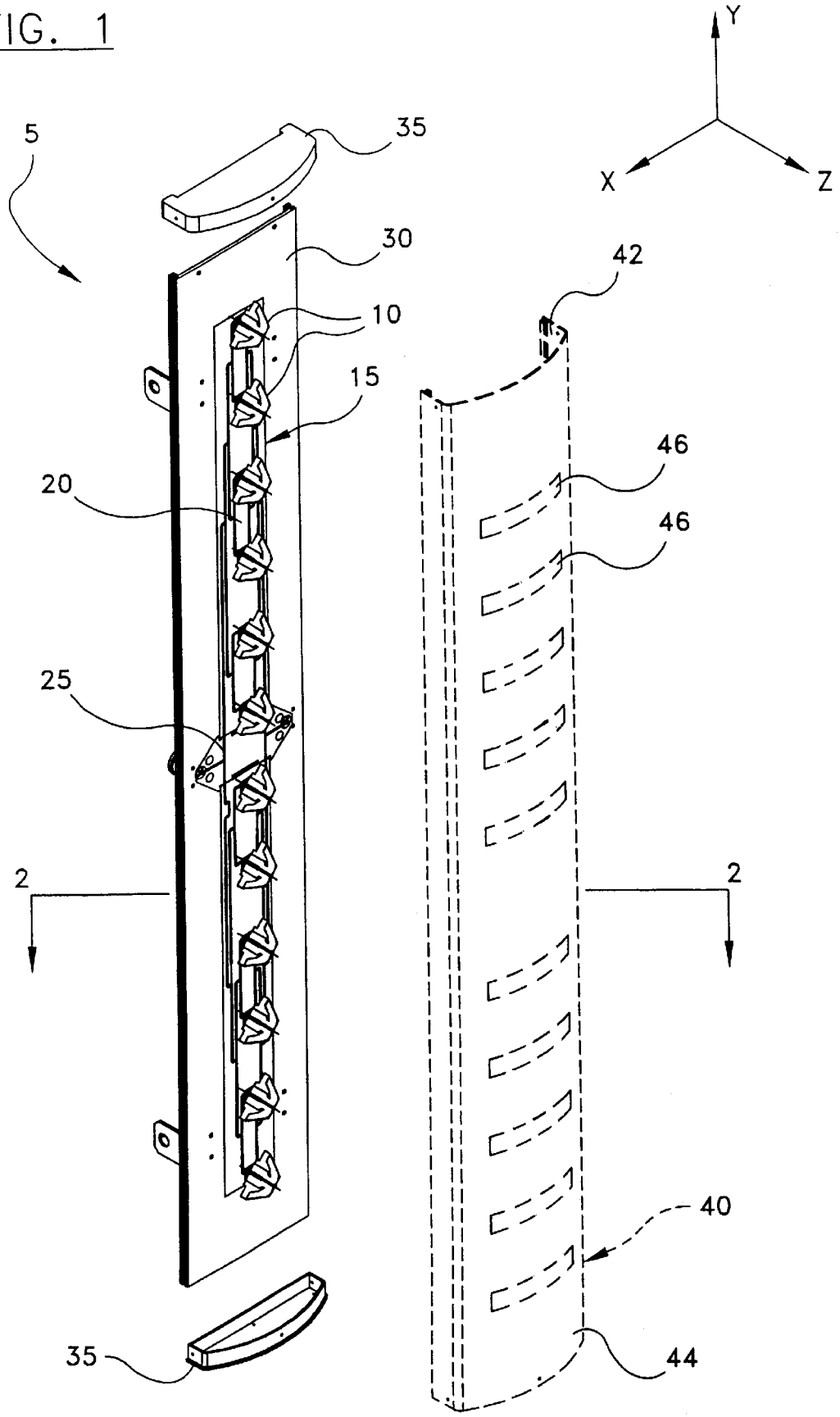
FIG. 1 is an exploded assembly view of an antenna system, including a distribution network, radiating elements, a radome (shown in phantom view) and a feedback element, constructed in accordance with an exemplary embodiment of the present invention.

The antenna system of the present invention is useful for wireless communications applications, such as Personal Communications Services (PCS) and cellular mobile radiotelephone (CMR) service. For the purposes of illustrating the present invention, the exemplary embodiments of the present invention will be described in terms of their application to an antenna system utilizing an antenna having dual polarized radiating elements. The use of antennas having dual polarized radiating elements is becoming more prevalent in the wireless communications industry due to the polarization diversity properties that are inherent in the antennas and are used to mitigate the deleterious effects of fading and cancellation that often result from today's complex propagation environments.

In general, the antenna system includes multiple dual polarized radiating elements forming an array coupled relative to a distribution network. The distribution network generally comprises a beam-forming network (BFN) having a power divider network for facilitating array excitation. In combination with the radiating elements, a conductive surface operative as a radio-electric ground plane supports the generation of substantially rotationally symmetric patterns over a wide field of view for the antenna. The preferred orientation of element polarizations in a linear array of dual polarized radiating elements is a slant (45 degrees) relative to the array (y-axis) so to achieve the best balance in the element pattern symmetry in the presence of the mutual coupling between the elements. Representative dual polarized radiator antennas are described in U.S. patent application Ser. Nos. 08/572,529 and 08/783,399, both assigned to the assignee for the present application, and incorporated herein by reference.

An exemplary embodiment of the present invention comprises a feedback system incorporated into the dual polarized antenna system and provides for the electrical coupling of a feedback signal to the radiating elements, thereby facilitating improvement of the isolation characteristics of the antenna system. Feedback elements are operatively positioned within the dual polarized antenna system relative to the radiating elements so to achieve the desired amount of coupling between the radiating elements and the feedback elements. The feedback signals are similar in frequency but differ in phase when compared to the transmitted electromagnetic signals. With the appropriate amount of coupling, a feedback signal having the correct phase and amplitude will be produced which, in turn, will result in the desired amount of isolation being achieved within the antenna system.

One exemplary embodiment of the present invention incorporates the implementation of feedback elements as spaced-apart conductive strips placed on the interior surface of a radome. The conductive strips are placed such that, when the radome is installed on the dual polarized antenna system, the conductive strips are spaced apart from the radiating elements by the height of the radome. Those skilled in the art will understand that the feedback system of the present invention can readily accept other forms of feedback elements having many different spacing configurations with equal success in achieving the improved port-to-port isolation characteristic for the antenna system. Further, it will be understood that the feedback system of the present invention can be readily applied to antennas other than dual polarized antennas employing crossed-pair dipoles. For example, the principles of the present invention can readily be used in patch antenna system designs.

Turning now to FIG. 1, which illustrates an exemplary embodiment of the present invention, specifically a feedback system for an antenna having an array of dual polarized radiating elements aligned in a slant (45 degrees) configuration relative to the array (y-axis). FIG. 1 presents an exploded view of a dual polarized radiator antenna 5, also generally referred to as the antenna system 5. The antenna system 5 includes radiating elements 10 and a distribution network 15 to facilitate the excitation of the radiating elements 10. The distribution network 15 includes a beam forming network 20 (BFN) that incorporates a power divider network 25. The antenna system 5 further includes a ground plane structure 30 positioned adjacent to the distribution network 15 and over which the radiating elements 10 are coupled relative to. At the opposing ends of the ground plane structure 30, a pair of end caps 35 are cooperatively positioned to form a seal with the ground plane structure 30. To cover the radiating elements 10, a radome 40 having an interior surface 42 and an exterior surface 44 can be seen in phantom view. The radome 40 includes feedback elements 46 aligned parallel to one another along the longitudinal axis of the radome 40. The feedback elements 46 are positioned on the interior surface 42 of the radome 40 to facilitate encapsulating the feedback elements 46 within the overall housing of the antenna system 5 and, hence, protecting these elements from the outside environment. The pair of end caps 35 in conjunction with the ground plane structure 30 and the radome 40 cooperate to effectively seal the interior of the antenna system 5 from the outside environment.

Figure 2:
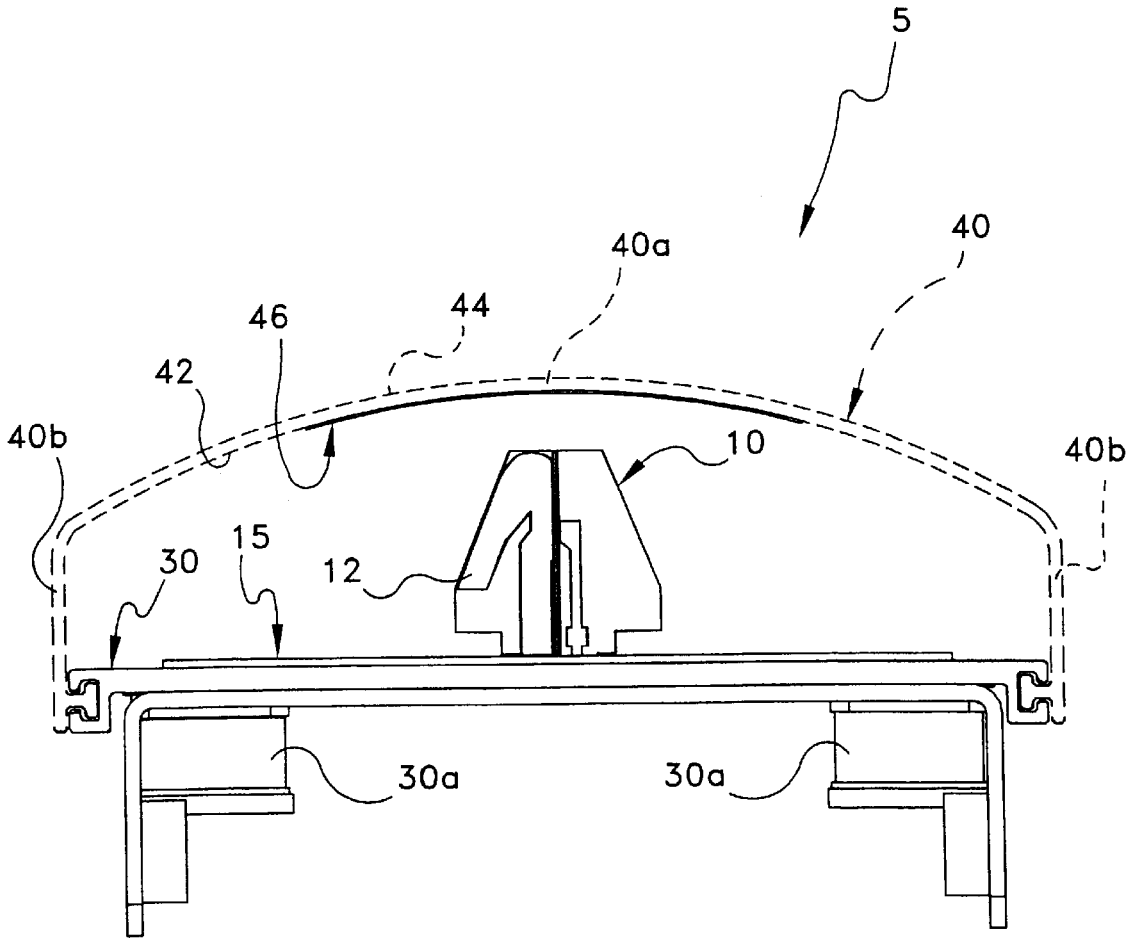
FIG. 2 is a cross-sectional view of the antenna system shown in FIG. 1, as viewed from line 2—2, showing the relative positions of the radome, the feedback element, at least one of the radiating elements, and the distribution network.

The antenna system 5 of FIG. 1 is shown in an assembled state in FIG. 2, where a cross-sectional assembly view of the antenna system 5 is illustrated as taken along the line 2—2 in FIG. 1. The radiating element 10 is positioned along the center line of the ground plane structure 30 and coupled to the distribution network 15. The radiating element 10, shown in a side elevational view, further includes dipole arms 12 (only one arm of one dipole is illustrated in FIG. 2). The radiating element 10 utilized in the antenna system 5 will be described in more detail later in conjunction with FIGS. 6A–6F. The distribution network 15 is coupled to and extends across the ground plane structure 30 in a parallel manner. Thus, the distribution network 15 and the ground plane structure 30 combine to form, in effect, a two-ply rigid structure for supporting the radiating elements 10 and the radome 40. In addition, an input port 30*a* and an output port 30*b*, located at the approximate central point of the antenna system 5, are coupled to and extend outward from the ground plane structure 30, opposite the radiating elements 10. The input port 30*a* and the output port 30*b* are connected to the distribution network 15.

As shown in FIG. 2, the radome 40 engages the ground plane structure 30 along the longitudinal edges of the ground plane structure 30. The radome 40 is generally U-shaped and has a slightly curved center portion 40*a* and integral upstanding wall portions 40*b*. The curved center portion 40*a* extends directly over the radiating elements 10 when the radome 40 is properly engaged with the ground plane structure 30. Thus, when the radome 40 engages the ground plane structure 30, a cavity is formed within which the radiating elements 10 are enclosed. The interior surface 42 of the curved center portion 40*a* has a generally smooth texture which readily facilitates receiving the feedback elements 46 thereon. It is noted that the radome 40 of this exemplary embodiment is preferably formed from a suitable material exhibiting a transparent behavior at the frequencies of the transmitted electromagnetic signals. In addition, with the material of the radome 40 also exhibiting properties capable of withstanding the harsh outside elements, the radome 40 serves to provide an effective environmental barrier between the radiating elements 10 located within the antenna system 5 and the outside environment.

In FIG. 2, the feedback elements 46 are located on the interior surface 42 of the curved center portion 40*a* and, thus, are positioned directly above and sufficiently close to the radiating elements 10 to support the coupling of signals between the feedback elements 46 and the radiating elements 10. For example, the electromagnetic signals transmitted by the radiating element 10 can be electrically coupled into the feedback elements 46. This signal coupling effect causes the feedback element 46 to resonate, thereby generating a feedback signal for subsequent reception by the radiating element 10.

The presence of a feedback signal in the antenna system 5, which is generated via the resonating feedback elements 46, can cancel leakage signals present at the output port 30*b*. Leakage signals can appear at the output port 30*b* as a result of signals fed into the input port 30*a* and electrically coupling to the output port 30*b*. Possible leakage signal coupling paths within a typical antenna can include coupling via the ground plane, coupling by way of radiators 10 physically positioned too close to one another, or coupling via the distribution network 15. This undesired coupling of at least a portion of the input signal from the input port 30*a* to the output port 30*b* adds to the overall degradation of the isolation characteristics of the antenna system 5. Hence, in addressing these undesired leakage signals, one will appreciate that it is preferable to generate a feedback signal having a specific amount of amplitude and associated phase to achieve the appropriate cancellation of any leakage signal that may be present at the output port 30*b*.

The feedback signal, which is coupled back into the radiating elements 10 from the feedback elements 46, acts to cancel the leakage signal because the feedback signal is identical in frequency and has a 180 degrees phase difference. Thus, when the feedback signal and leakage signal sum at the output port 30*b*, the 180 degree phase difference between the signals effectively cancels both signals. With the 180 degree difference in respective phases providing for the cancellation of the signals, the remaining issue, in assuring a complete cancellation of a leakage signal, is to generate a feedback signal having an amplitude equal to the amplitude of the leakage signal. Therefore, in the exemplary embodiment of the present invention, empirical measurements are conducted to determine the proper number of feedback elements 46 and the proper orientation of each feedback element 46 relative to the radiators 10. This is required to obtain a feedback signal having the appropriate amplitude and associated phase so to achieve the complete cancellation of a leakage signal at the output port 30*b*.

Figure 3A:
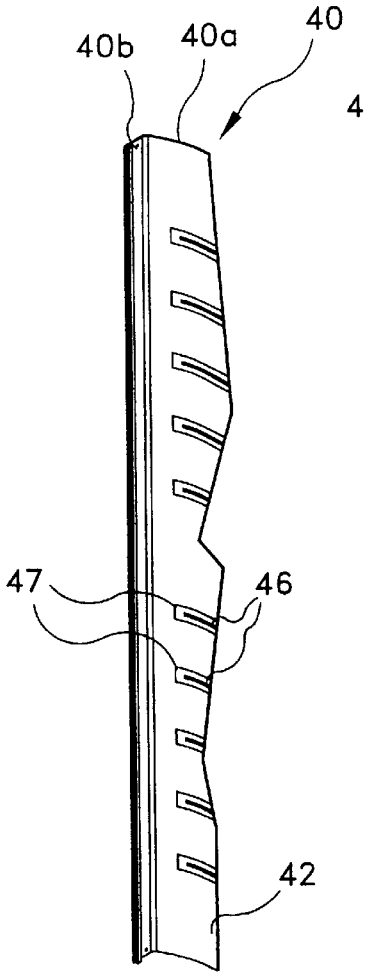
FIGS. 3A, 3B, and 3C are respective partial, top plan and perspective views of the radome shown in FIG. 1.
Figure 3B:
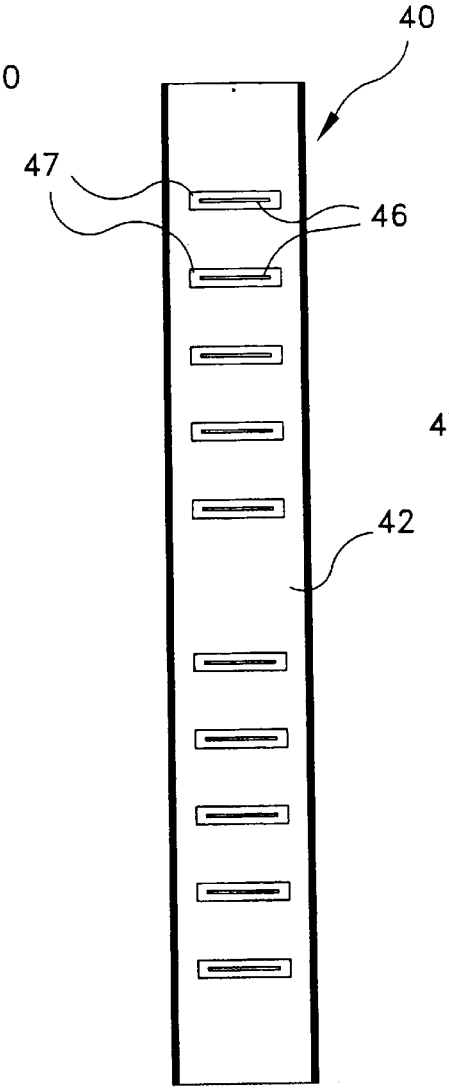
Figure 3C:
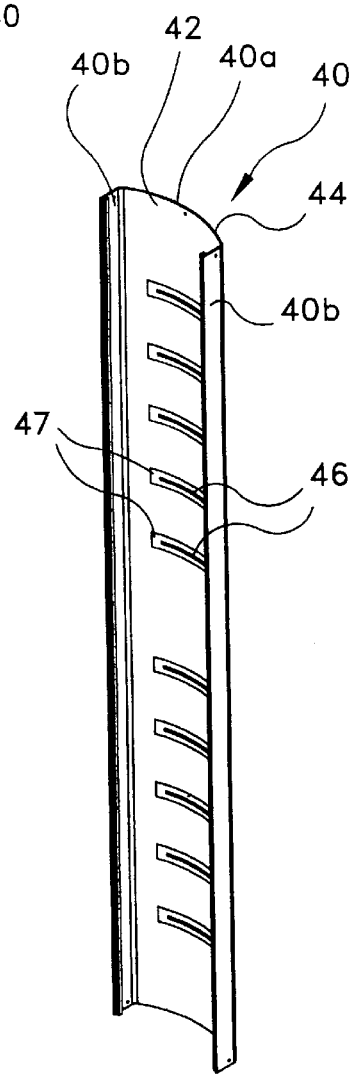
Figure 4:
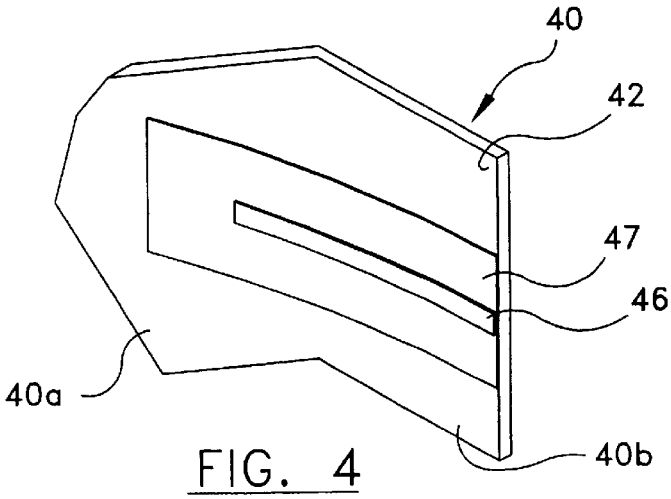
FIG. 4 is an enlarged partial view of a feedback element coupled to the interior surface of the radome shown in FIG. 1.

The radome 40 illustrated in FIGS. 1 and 2 can be seen in further detail in its complete form by referring now to FIGS. 3A–3C. In FIG. 3B, the feedback elements 46 are coupled to the curved center portion 40*a* of the radome 40 and aligned parallel to each other along the longitudinal axis of the radome 40. The slightly curved nature of the radome 40 is evidenced in FIGS. 3A and 3C, as well as in FIG. 2 as discussed above. To provide further protection from the environment (i.e. corrosion, etc.) and a better securement to the radome 40, the feedback elements 46 each can include a seal 47 that covers the feedback element 46 and adheres to the interior surface 42. The seal 47 can be seen in more detail by referring now to FIG. 4. The seal 47 is generally rectangular in shape and designed to cover the feedback element 46 with sufficient overlap to ensure a solid adherence to the interior surface 42 of the radome 40. The seal is preferably formed from a pliable material having a suitable dielectric constant and a sufficient bonding capability for further securing and retaining the feedback element 46 in its optimal position.

Each feedback element 46 on the radome section 48 typically comprises a conductive strip that is preferably ½-wavelength in length. With the length of the feedback element 46 set to ½-wavelength, resonance should occur at the frequency of the electromagnetic signals being transmitted from the radiators 10. As for the width of the conductive strip, it is preferable that the width be ⅛ of an inch (1/48-wavelength) for an antenna operating at in the 1.85–1.99 GHz range. However, it is noted that the conductive strip of feedback element 46 can be made of various other widths to provide the required resonance effect depending upon the frequencies involved and the specific application at hand. It is further noted that the width directly affects the amount of coupling that can be achieved from each feedback element 46 and, thus, the widths may vary from one application to another depending on the amount of required coupling. The conductive strips used to form the feedback elements 46 are preferably formed from a highly conductive copper tape having an adhesive layer on one side for adherence to the interior surface 42 radome 40.

Figure 5:
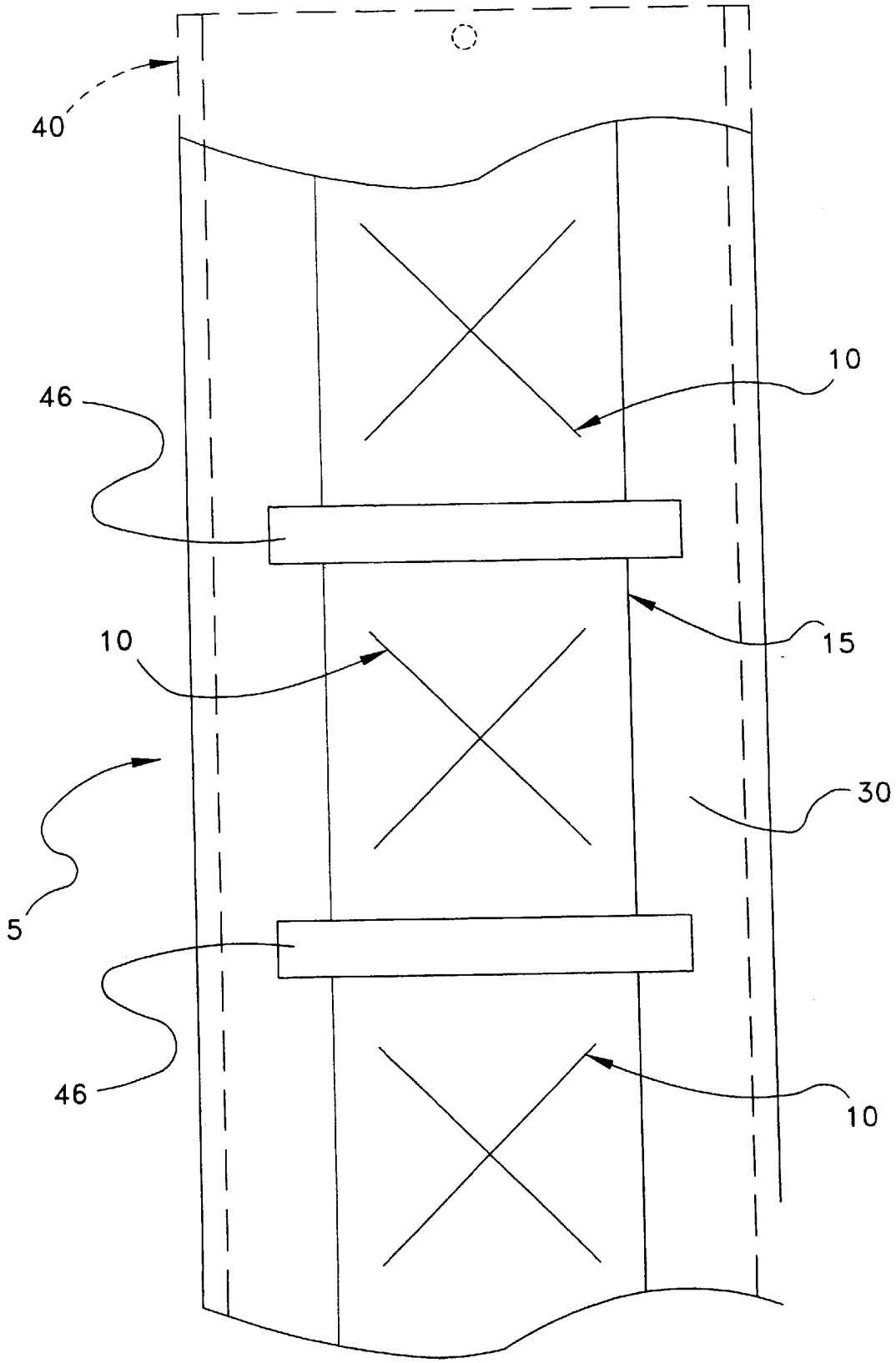
FIG. 5 is a top plan view of the antenna system of FIG. 1 illustrating the positioning of the feedback elements on the distribution network relative to the radiating elements on the radome (shown in phantom).
Figure 6A:
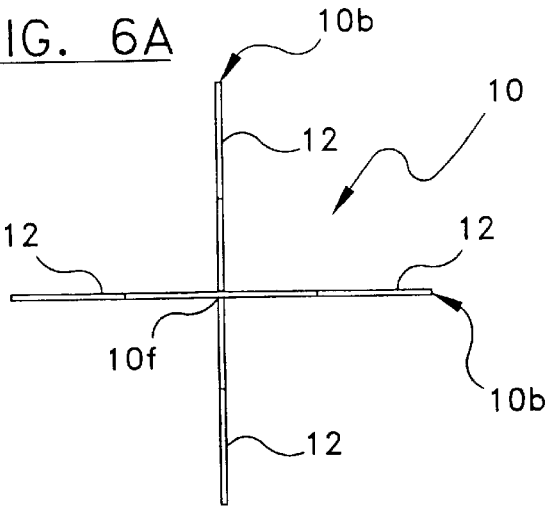
FIGS. 6A, 6B, and 6C are respective top plan, side elevational and perspective views of a radiating element of the antenna system shown in FIG. 1.
Figure 6D:
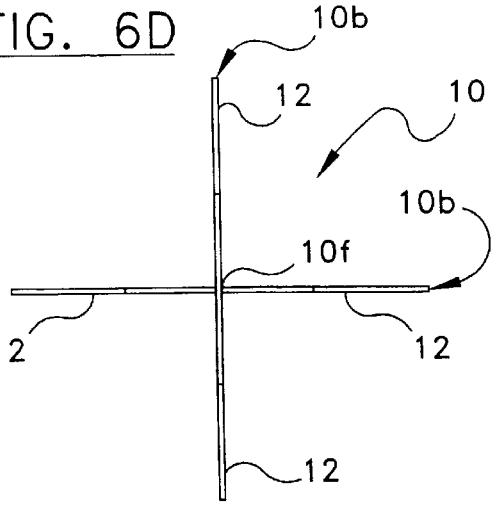
FIGS. 6D, 6E, and 6F are respective top plan, side elevational and perspective views of a radiating element of the antenna system shown in FIG. 1.
Figure 6B:
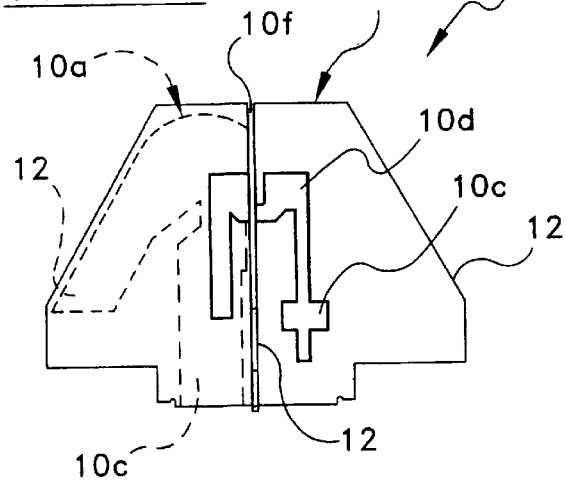
Figure 6E:
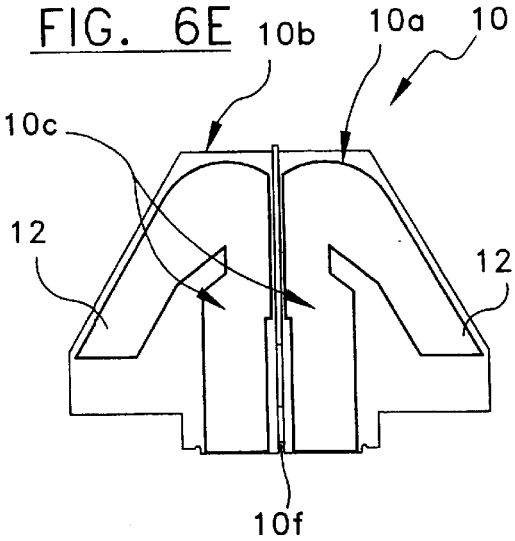
Figure 6C:
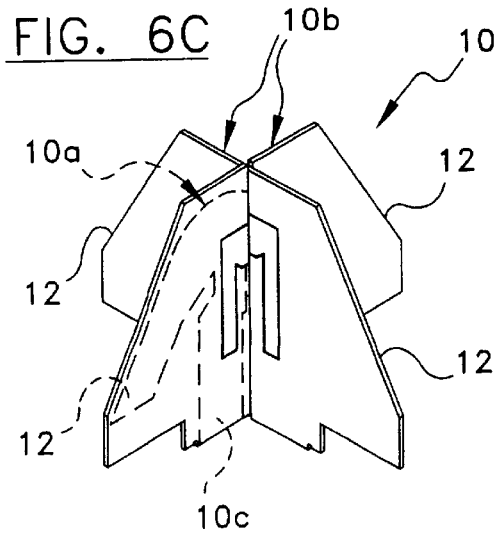
Figure 6F:
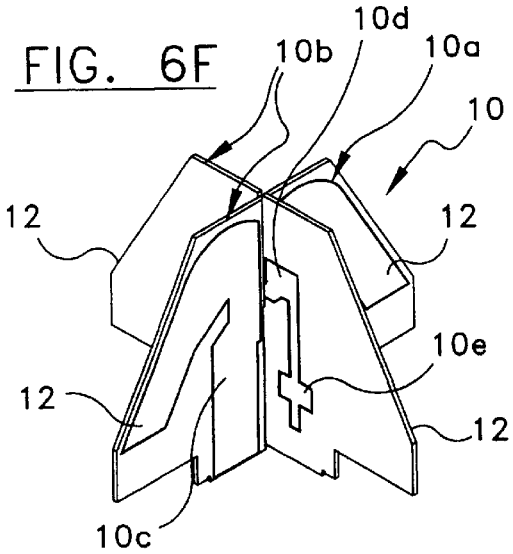
Figure 7A:
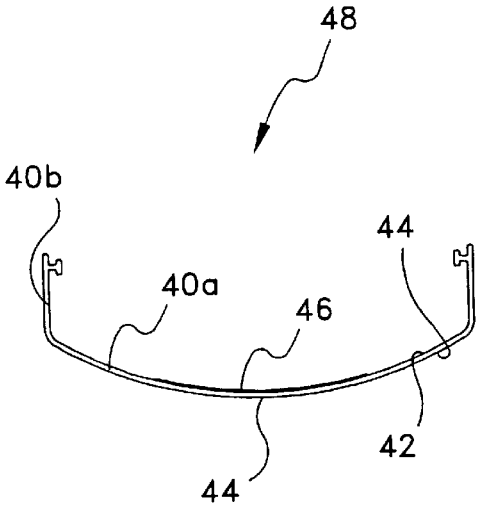
FIGS. 7A, 7B, and 7C are respective side elevational, perspective and top plan views of a radome section having a feedback element positioned on an interior surface for use during an initial adjusting stage before incorporating multiple feedback elements into a single radome structure in accordance with an exemplary embodiment of the present invention.
Figure 7B:
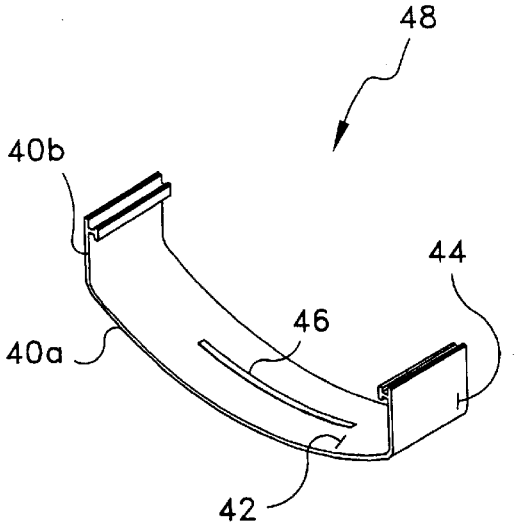
Figure 7C:
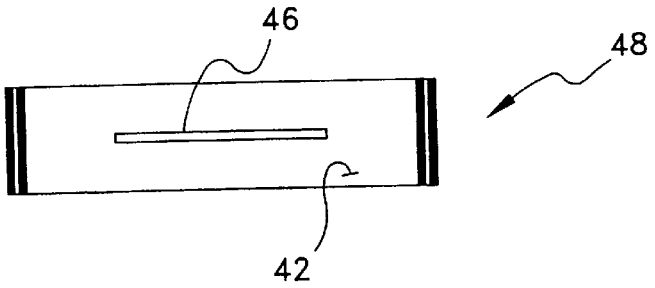

Having described the alignment of the feedback elements 46 relative to the radome 40 with respect to FIGS. 3A–3C, the alignment of the feedback elements 46 relative to the radiating elements 10 is now described with reference to FIGS. 1 and 5. FIG. 5 shows a top plan view of the antenna system 5 (radome 40 shown in phantom) and illustrates the spacing of the radiating elements 10 and the feedback elements 46, as well as their respective positioning relative to each other. In the exemplary embodiment as depicted in FIG. 5, the radiating elements 10 are evenly distributed along the longitudinal axis of the ground plane structure 30 and spaced apart by a specific distance. The actual distance is dependent upon the frequency range for which the antenna system 5 is designed to operate within. For a representative wireless communication industry application having a frequency range of 1.85–1.99 GHz, a distance of approximately 4.3 inches (7/10-wavelength) can be utilized for the spacing of the radiating elements 10. It is noted that other distances may be required for the spacing of the radiating elements 10 as may be dictated by each specific application of the antenna.

For the feedback elements 46, FIG. 5 illustrates that they are distributed in a consistent fashion with one feedback element 46 positioned between every two radiating elements 10. The feedback elements 46 are specifically aligned along and perpendicular to the center line of the antenna system 5 and positioned relatively midway between every pair of radiators 10. With the feedback elements placed in such a manner the proper coupling of the feedback signal to the radiators 10 will be facilitated. In this manner, each feedback element 46 can electrically couple electromagnetic signals relative to at least two spaced-apart radiating elements 10 and thereby contribute to the generation of an aggregate feedback signal having the desired amplitude and phase characteristics. As described above in reference to the spacing of the radiating elements 10, the feedback elements 46 are also spaced approximately 4.3 inches (7/10-wavelength) apart from each other for an application involving the frequency range of 1.85–1.99 GHz. The spacing of the feedback elements 46 from the ground plane structure 30, as measured from the peak arc of the radome 40, is approximately 2.5 inches (13/32-wavelength) in the exemplary embodiment illustrated in FIGS. 1 and 2. The actual positioning of each feedback element 46 along the radome 40, however, is ultimately determined empirically during the implementation of a feedback system for the antenna system 5. The positioning of the feedback elements 46 is dictated by the need, within this exemplary embodiment, to receive electromagnetic signals transmitted by the radiating elements 10 and to electrically couple electromagnetic signals to the radiating elements 10. Ultimately, the actual spacing and configuration of the feedback elements will depend upon the particular application at hand.

With the feedback elements 46 positioned properly, as dictated by the specific application, the feedback signal that is electrically coupled to the radiating elements 10 will have the correct amplitude and associated phase so to accomplish the necessary cancellation of any leakage signals at the output port 30*b*. As described previously, the cancellation of any leakage signals that may be present at the output port 30*b* is accomplished by virtue of the respective associated phases of the feedback and leakage signals differing by approximately 180 degrees. Therefore, when the two signals sum together at the output port 30*b*, the feedback and leakage signals cancel each other.

Referring to FIGS. 6A–6F, various views illustrating the radiating element 10 are shown. Each radiating element 10 generally comprises two dipole antennas 10*a* arranged in a crossed pair configuration. Each dipole antenna 10*a* is formed on one side of a dielectric substrate 10*b*, which is metallized to form the necessary conduction strips for a pair of dipole arms 12 and a dipole body 10*c*. The dipole arms 12 are designed having a swept-down pattern to form an inverted "V"-shape. The dipole antenna 10*a* is photo-etched (also known as photolithography) on the dielectric substrate 10*b*. The dielectric substrate 10*b* is a relatively thin sheet of dielectric material and can be one of many low-loss dielectric materials used for the purposes of radio circuitry. The width of the strips forming the dipole arms 12 is typically chosen to provide sufficient operating impedance bandwidth of the radiating element 10. The same face occupied by the swept-down dipole arms 12 contains the dipole body 10*c*, which comprises a parallel pair of conducting strips or legs useful for electrically connecting the dipole arms 12 to the beam forming network 20.

Additionally, on the face of the dielectric substrate 10*b* opposite the dipole antenna 10*a*, a feed line 10*d* is positioned having a microstrip form that serves to couple energy into the dipole arms 12. As before, the microstrip feed line 10*d* is photo-etched on the surface of the dielectric substrate 10*b*. The feed line 10*d* also includes a balun 10*e* that facilitates the impedance matching of the dipole antenna 10*a* to a 50-ohm impedance transmission line that supplies the signals to the radiating element 10. Each dielectric substrate 10*b* further includes a slot 10*f* running along the center portion of the dielectric substrate 10*b*. The slot 10*f* runs within a nonmetallized portion of the dielectric substrate 10*b* that separates the parallel strips of the dipole body 10*c*. When the two dielectric substrates 10*b* are joined and crossly oriented, the two dielectric substrates 10*b* are physically joined by interleaving the slots 10*f*. With the slots 10*f* being interleaved as such, the dipole antennas 10*a*on the respective dielectric substrates 10*b* are resultingly positioned orthogonal to each other. As well, the microstrip feed lines 10*d* located on the opposite sides of the dielectric substrates 10*b* are arranged in an alternating over-under arrangement within a cross-over region to prevent a conflicting intersection of the two feed lines for the dipole antennas 10*a*. The crossly oriented dipole antennas 10*a* are largely identical in their features except for the details near the crossover region of the feed lines 10*d*. Therefore, when the radiating elements 10 are positioned in slant (45 degree) configurations, the feedback elements 46, being positioned perpendicular to the longitudinal axis of the ground plane structure 30, will be positioned non-orthogonally with respect to the dipole arms 12 of each of the dipole antennas 10*a*. It is preferred that the feedback elements 46 be positioned in a non-orthogonal manner with respect to the radiating elements 10 so that adequate electrical coupling will be achieved. However, other configurations may vary from the strict non-orthogonal relationship as the specific amount of feedback in the application at hand dictates.

Now that the overall structure and location of the feedback elements 46 have been described with particularity in the context of the radiator 10 of a representative dual polarized radiator antenna, an exemplary method for determining the placement along the radome 40 of the feedback element relative to the radiators will now be described in detail with reference to FIGS. 7A–7C and FIGS. 8A–8C. As an initial operational overview, an exemplary embodiment of the present invention generally operates to introduce a feedback signal into the antenna system 5 by placing feedback elements 46 at operative positions adjacent the radiating elements 10, also referred to as radiators 10, such that electromagnetic signals are coupled between the radiating elements 10 and the feedback elements 46. Each feedback element 46 is designed to resonate at the frequency of a transmitted electromagnetic signal and to couple to the radiating elements 10 a feedback signal having a frequency identical to the transmitted electromagnetic signal, but exhibiting a difference in phase. The feedback element 46 is preferably sized to resonate at the frequency of the transmitted electromagnetic signals based on a half-wavelength equivalent. Thus, when the feedback signal is received by the radiators 10, the phase associated with the feedback signal will be optimally 180 degrees different from the phase associated with a leakage signal at the output port 30*b*. The difference in phases between the signals will operate to cancel both the feedback and leakage signals at the output port 30*b* of the antenna system 5.

Figure 8A:
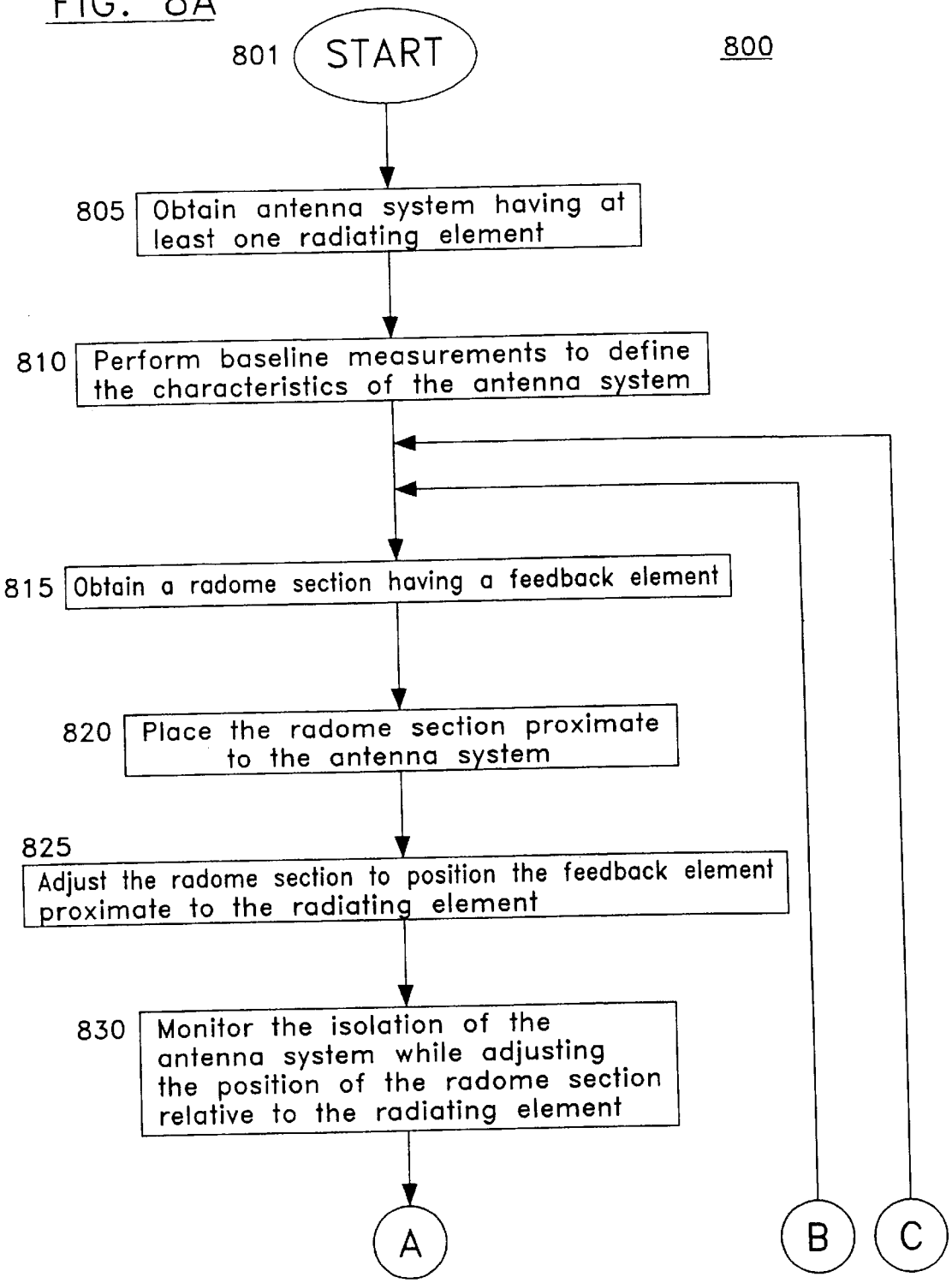
FIGS. 8A, 8B and 8C are flow diagrams illustrating the steps of a method for implementing feedback elements within an antenna system to improve isolation characteristics in accordance with an exemplary embodiment of the present invention.
Figure 8B:
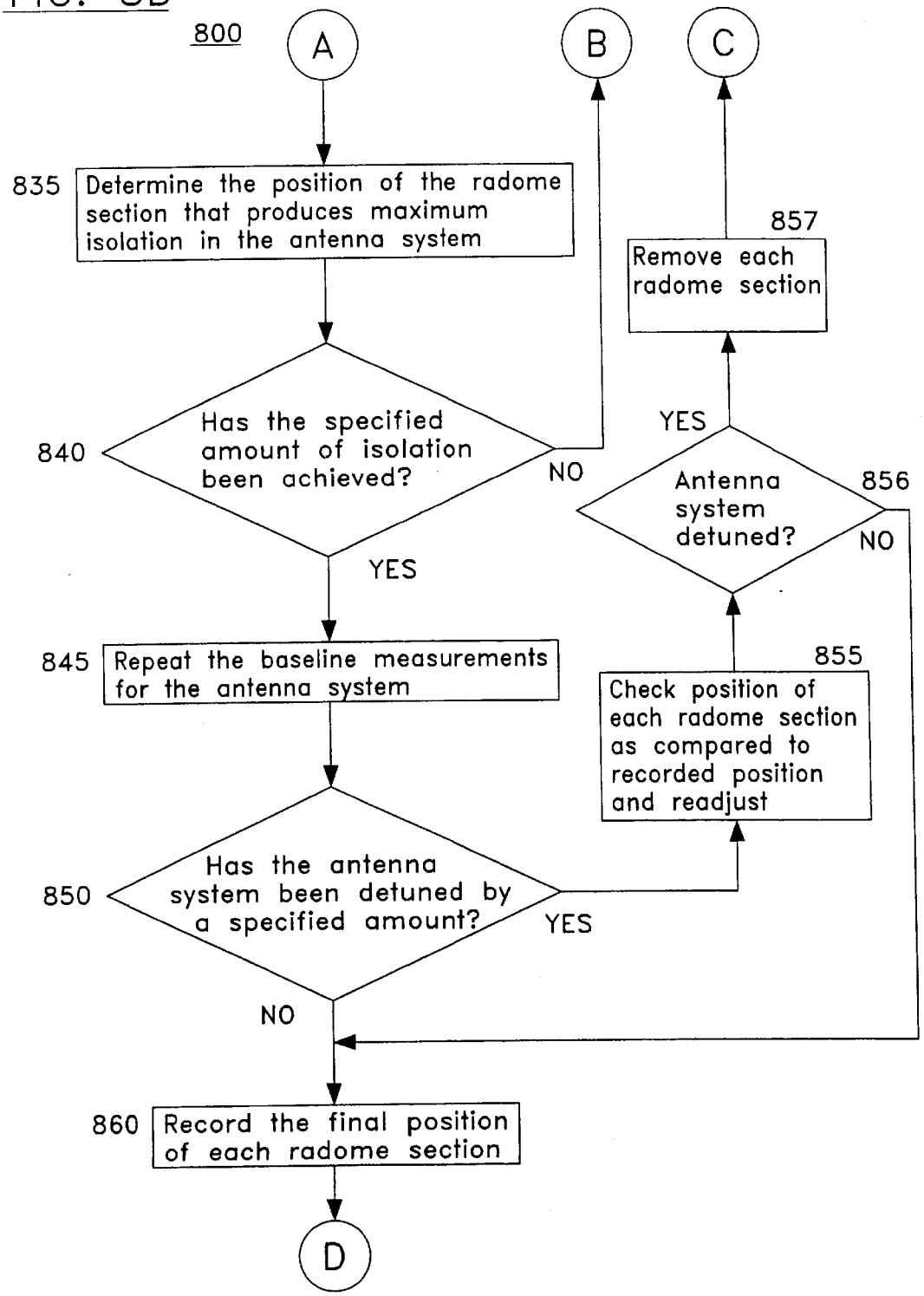
Figure 8C:
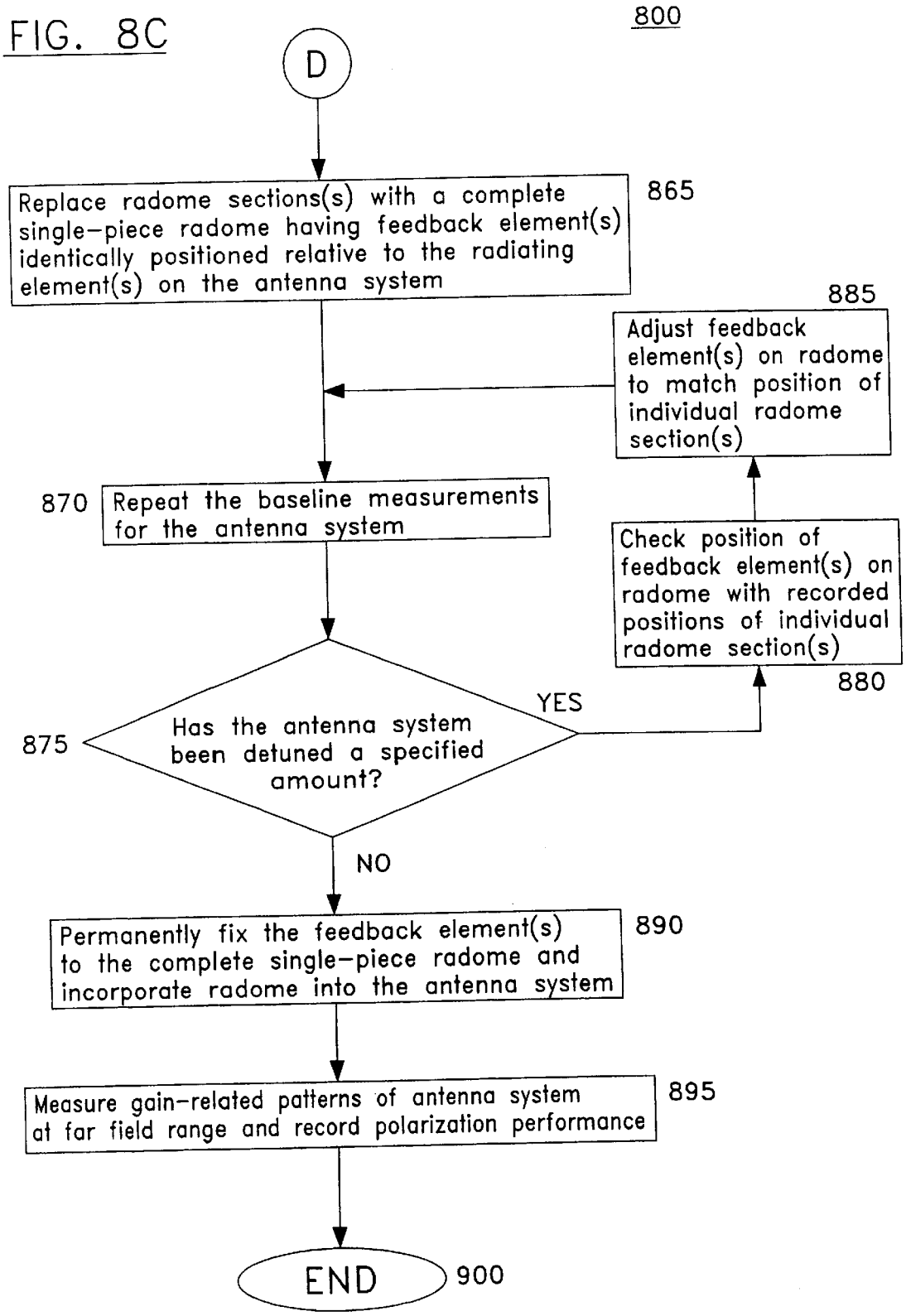

Referring generally to FIGS. 8A–8C, and particularly to FIG. 8A, an exemplary method 800, useful for empirically determining the position of feedback elements on a radome relative to radiators of an antenna, is illustrated in the form of a flow diagram. The method 800 starts at step 801 and continues to step 805 to obtain an antenna system 5 having at least one radiating element 10. Once the antenna system 5 is obtained for the purpose of improving its isolation characteristics, a series of measurements are performed in step 810 to establish a baseline for the antenna system 5. These baseline measurements typically include Voltage Standing Wave Ratio (VSWR), gain patterns and overall isolation characteristics. Once these baseline measurements have been completed for the antenna system 5, a feedback signal can be introduced into the antenna system 5 by obtaining a radome section 48 having a feedback element 46, as illustrated at step 815 and depicted in FIGS. 7A–7C.

The radome section 48 is placed on the antenna system 5 such that the feedback element 46 is positioned proximate to at least one of the radiators 10, as illustrated at step 820 and depicted in FIG. 2. The feedback element 46 is positioned on the interior surface 42 of the radome section 48 in such a manner that, when the radome section 48 is connected to the ground plane structure 30, the feedback element 46 is configured perpendicular to the longitudinal axis of the ground plane structure 30. The radome sections 48 are typically small, equally sized, fractional portions of identical radome material that, when combined, would form a complete radome 40 for the antenna system 5. Each radome section 48 includes, as similarly described before in reference to the radome 40, a curved center portion 40*a* and integral upstanding wall portions 40*b*.

Turning again to FIGS. 7A–7C and 8A–8C, after placing the radome section 48 on the antenna system 5, the radome section 48 is adjusted with respect to the radiators 10 by being translated along the longitudinal axis until the feedback element 46 on the radome section 48 is positioned in the operative proximity of a radiator 10, as illustrated at step 825. When the radome section 48 is positioned in the operative proximity of a radiator 10, the transmitted electromagnetic signals emitted by the radiator 10 can be coupled to the feedback element 46. In response, the feedback element 46 can resonate at the frequency of the transmitted electromagnetic signals and generate a feedback signal that is electrically coupled back into the radiator 10. While the position of the radome section 48 is adjusted at step 825, the isolation of the antenna system 5 can be monitored during step 830.

Referring now to FIG. 8B, the maximum amount of isolation achieved during the adjustment of the radome section 48 is determined and recorded at step 830. This is generally determined while continually monitoring the isolation characteristics during the adjusting procedure, as in step 830, until a maximum isolation point is determined with the particular radome section 48. The final optimal positioning of the feedback element 46 is typically at a point located between the radiators 10.

At step 840, it is determined whether the desired amount of isolation for the antenna system 5 has been achieved as related to the maximum amount of isolation determined and recorded for the position of the first radome section 48. If the specified amount of isolation has been obtained with the optimal positioning of the radome section having a first feedback element, then the method 800 proceeds to step 845 where the baseline measurements are repeated.

However, if the specific amount of desired isolation for the antenna system 5 has not yet been achieved after positioning the radome section 48, then the method 800 returns to step 815. Additional radome sections 48, each having a feedback element 46, can be added one at a time by looping through steps 815–840 until the specific amount of desired isolation is finally obtained. Once the desired isolation has been obtained at step 840 by utilizing the appropriate number of feedback elements 46, the method 800 then proceeds to step 845.

At step 845, the baseline measurements are completed again by (1) checking the VSWR to ensure that the antenna system 5 has not been significantly detuned and (2) measuring the gain-related patterns of the antenna system 5 to ensure that no distortion has occurred. After performing the baseline measurements on the antenna system 5 at step 845, the method 800 proceeds to step 850 to determine whether the antenna system 5 has been detuned by a specified amount.

If it is determined at step 850 that the antenna system 5 has not been detuned by a specified amount, then the method 800 proceeds to step 860. If, however, it is determined at step 850 that the antenna system 5 has been detuned by a specified amount with respect to VSVWR or pattern gain, the position of each radome section 48 is then checked in step 855 to verify proper positioning with regards to its previously recorded position. If necessary, the position of a radome segment is adjusted to match the recorded position. At step 856, it is determined, after any readjustments made during step 855, whether the antenna system 5 is still detuned by a specified amount. If the antenna system 5 is no longer detuned, then the method 800 proceeds to step 860. However, if the antenna system 5 is still detuned after any readjustments from step 855, then the radome sections 48 are removed from the antenna system 5, as illustrated at step 857. From step 857, the method 800 returns to step 815, where the tuning process is started again with a first radome section 48 being positioned on the antenna system 5. The method 800 then similarly proceeds through the tuning process again as was previously described above regarding steps 815 through 856 until the desired degree of isolation is achieved without experiencing a specified amount of performance degradation.

It is noted that the specified amount of performance degradation resulting from the feedback system to be tolerated is ultimately determined by the user and the specification requirements (i.e., minimum VSWR and gain pattern requirements, etc.) that apply to the particular antenna application at hand. For example, each particular antenna application typically has a specific amount of antenna gain and impedance matching that is required for the antenna to function properly with the other electronics associated with the application (i.e., amplifiers, receivers, etc.).

At step 860, the final position of each radome section 48, is recorded again relative to the radiating elements 10. Next, with reference now to FIG. 8C, the method 800 proceeds to step 865, where the individual radome sections 48 are incorporated into a complete single-piece radome 40 for the antenna system 5. The single-piece radome 40 includes feedback elements 46 positioned in the same orientation as previously determined and recorded with the individual radome sections 48. As illustrated in FIGS. 3A–3C, the radome 40 includes the feedback elements 46 aligned parallel to each other along the center-line of the radome 40.

After the radome 40 is constructed and positioned on the antenna system 5, as illustrated in step 865, the VSWR, gain-related patterns and isolation of the antenna system 5 are again measured in step 870. This ensures that the correct orientation of the feedback element(s) 46 were properly transferred from the individual radome section(s) 48 to the radome 40. At step 875, it is determined whether the antenna system 5 has been detuned a specified amount due to the transferring of the orientations of the feedback elements 46 from the radome sections 48 to the complete single-piece radome 40. If the antenna system 5 has not been detuned by a specified amount, then the feedback elements 46 are permanently fixed in their respective positions on the radome 40 and the radome 40, with the tuned feedback system within, is incorporated into the antenna system 5 as illustrated at step 890. If, however, it is determined at step 875 that the antenna system 5 has been detuned a specified amount during the transferring process to the complete single-piece radome 40, the positions of the feedback elements 46 are then rechecked on the radome 40 and compared to their respective recorded positions taken from the individual radome sections 48 as illustrated at step 880. Next, at step 885, the feedback elements 46 are readjusted on the radome 40 to match the previous orientations recorded from the individual radome sections 48.

After completing the necessary readjustments described in step 885, the method 800 returns to step 870 where the series of measurements as to VSWR, isolation and gain-related patterns are again performed on the antenna system 5. The method 800 then continues as previously described above until the feedback elements 46 have all been properly transferred to the complete single-piece radome 40 without experiencing a specified amount of performance degradation in the antenna system 5. Once verified, the gain-related patterns of the antenna system 5 can be measured at a far-field range with respect to the elevation and azimuth planes for recording the polarization performance as illustrated at step 895. The method 800 then ends at step 900.

The number of feedback elements 46 required to accomplish the desired isolation for the antenna system 5 is determined by the antenna application and signal coupling factors. For example the amount of coupling that can be achieved from each feedback element 46 is dependent on the height of the feedback element 46 relative to the radiator(s) 10. The closer the feedback elements 46 are to the radiators 10, the more coupling will take place. The length, width, and orientation of the feedback elements 46 relative to the radiators 10 all have a cumulative effect on the overall coupling that is achieved from each individual feedback element 46. Hence, the total number of feedback elements 46 utilized all have an additive effect for the isolation characteristic of the antenna system 5, resulting in a cumulative coupling of the feedback signal for canceling out the leakage signal at the output port 30*b*. It noted that the method 800 as described above can readily incorporate the use of various other feedback element configurations placed within the proximity of the radiators 10 with equal success in achieving the requisite feedback signal.

Figure 9A:
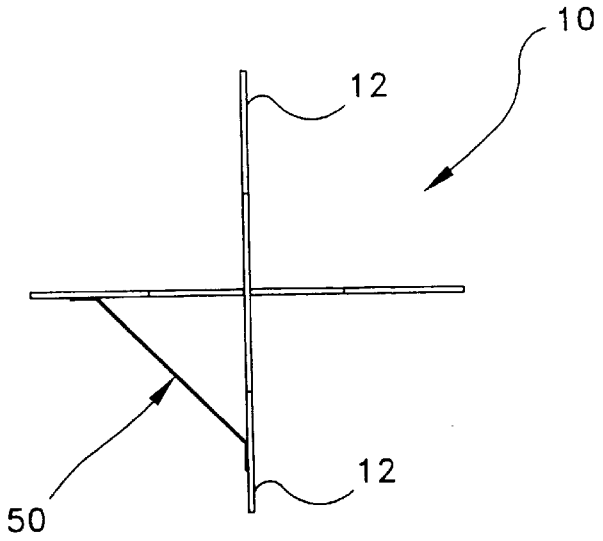
FIGS. 9A, 9B, and 9C are respective top plan, side elevational and perspective views of an radiating element having a feedback strip capacitively coupled to a radiating element in accordance with another exemplary embodiment of the present invention.
Figure 9B:
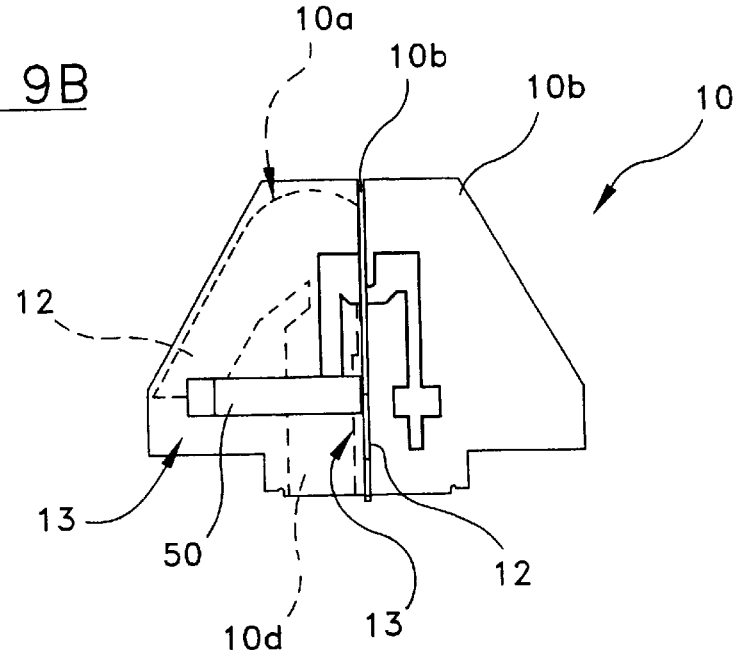
Figure 9C:
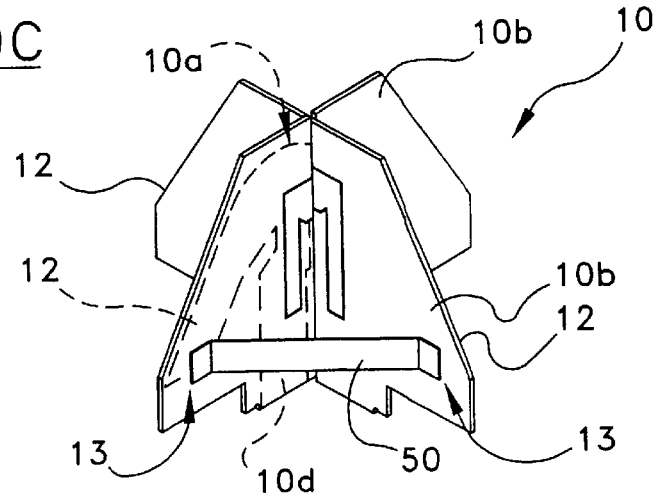

Referring now to FIGS. 9A–9C, an alternative exemplary embodiment is illustrated, wherein a feedback element 50 is utilized to achieve the generation and coupling of a feedback signal to the radiators 10. The feedback element 50 comprises a conductive strip that is connected to the individual radiators 10, which, for this embodiment, are arranged as a crossed-dipole pair of radiators. The feedback element 50 typically comprises a metallic strip, preferably formed from highly conductive copper tape, that is coupled to and between the ends of the crossed dielectric substrates 10*b*, on the opposite face of which are the arms 12 of individual dipoles 10*a*. However, it is noted that other electrically conductive materials commonly used in the antenna industry may be utilized to implement the feedback element 50. The conductive strip is preferably ⅛-wavelength in length and ⅜ inches (¾-wavelength) in width. Differing sizes may be utilized for the feedback element 50 as dictated by the particular application being undertaken and the specific frequencies that are involved.

As seen specifically in FIG. 9C, the feedback element 50 can be physically connected to the dielectric substrates 10*b* in such a manner that the arms 12 of the two crossly-oriented dipoles 10*a* are capacitively coupled to the feedback element 50. A feedback signal can be generated by the feedback element 50 via resonance in response to the transmission of an electromagnetic signal by the dipoles 10*a*. In turn, this feedback signal is coupled to the dipoles 10*a* through the dielectric substrate 10*b*. The feedback elements 50 are preferably attached near a bottom portion 13 of the dielectric substrates 10*b* because signal voltages approach a maximum level and signal currents approach a minimum level at the lower portion of the dipole arms 12. The placement of the feedback element 50 at the bottom portion 13 of the dielectric substrates 10*b* effectively places the feedback element 50 directly opposite the ends of arms 12 of the dipoles 10*a* and thereby further creates a more pronounced capacitive coupling effect. It will be appreciated that a significantly higher coupling effect is achieved per feedback element 50 positioned on the radiators 10 than is achieved with the use of the feedback elements 46 positioned on the interior surface 42 of the radome 40. Consequently, a smaller number of feedback elements 50 are generally required to produce the necessary coupling for achieving a specific amount of desired isolation for the antenna system 5.

After the feedback signal is generated via resonance in the feedback element 50 and electrically coupled to the dipoles 10*a*, the feedback signal is subsequently added to the leakage signal present at the output port 30*b*. The two signals can cancel each other by virtue of the phase difference between the signals being 180 degrees and the frequencies being identical. For a complete cancellation of the leakage signal at the output port 30*b*, the feedback signal must have the proper amplitude to, at a minimum, match the amplitude of the leakage signal.

Figure 10:
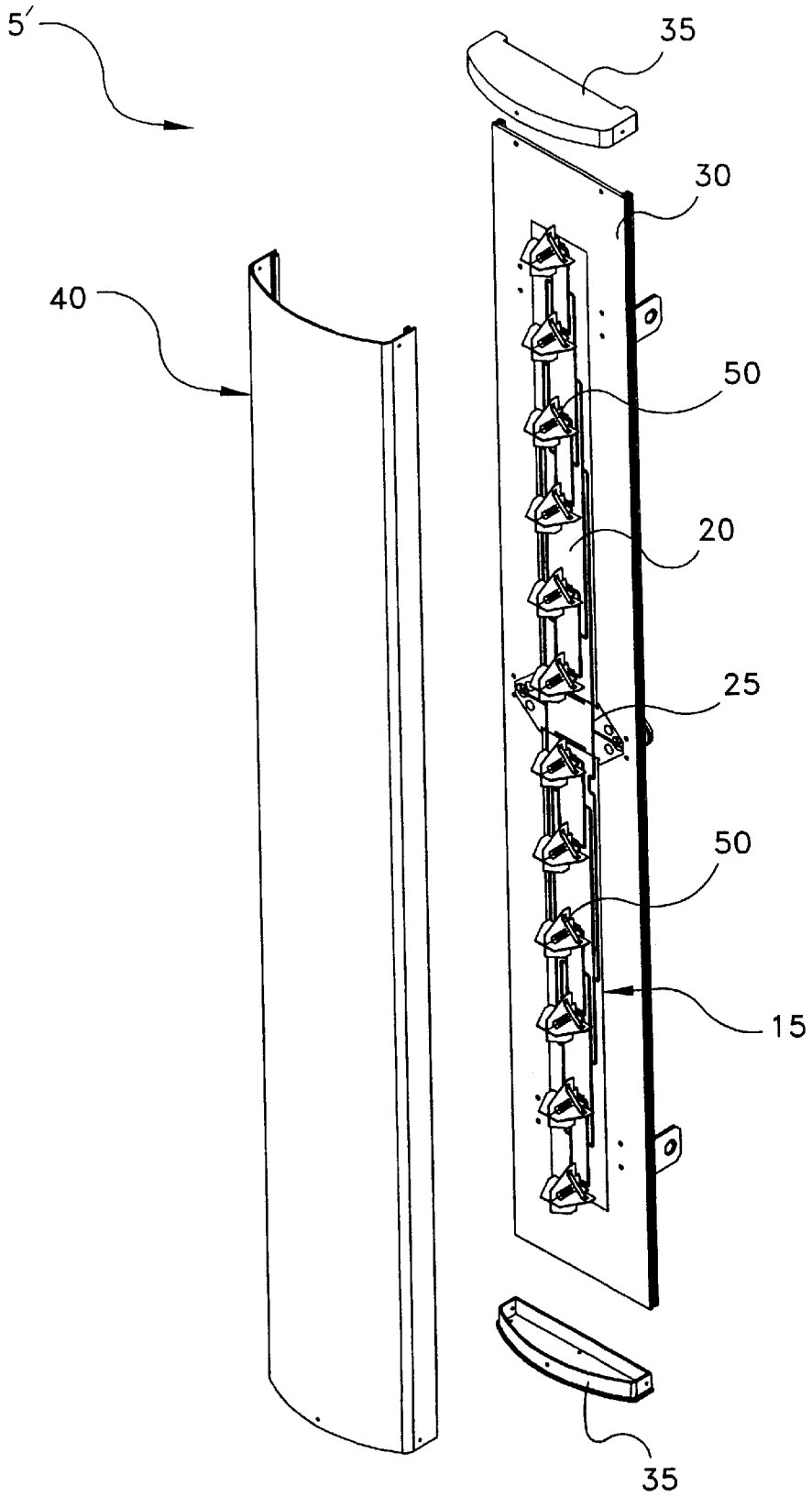
FIG. 10 is an exploded assembly view of an antenna system, including a radome, a distribution network, and the radiating elements, constructed in accordance with the exemplary embodiment shown in FIGS. 9A, 9B and 9C.

FIG. 10 illustrates an antenna system 5' comprising an array of radiators 10 including the feedback elements 50 positioned physically on the radiators 10. To incorporate the feedback element 50 into the antenna system 5', an adjustment method similar to the method 800 described above can be followed to establish a baseline for the antenna system 5' prior to the implementation of the feedback elements 50. However, feedback elements 50 are attached to radiators 10 one at a time until the desired isolation is achieved. The antenna system 5' is monitored for isolation while the feedback elements 50 are positioned on the individual radiators 10. Once the desired isolation is obtained, the antenna system 5' is then checked again for any performance degradation relating to VSWR and gain-related patterns. Once the desired isolation has been achieved and the performance of the antenna system 5' has not been degraded by a specified amount, the polarization performance of the antenna system 5' can then be measured and recorded at the far-field range.

The exemplary embodiment of the antenna system 5' illustrated in FIG. 10 shows feedback elements 50 in position on each of the radiators 10. The antenna system 5', as similarly described above in relation to the antenna system 5, can also be seen to include the ground plane structure 30, the distribution network 15 having the beam forming network 20 and the power divider network 25. The distribution network 15 and the ground plane structure 30 are coupled together in a parallel manner to effectively form a two-ply structure for supporting the radiators 10 and the radome 40. To complete the antenna system 5', the pair of end caps 35 are positioned at the opposing ends of the ground plane structure 30 and radome 40 so to seal the interior of the antenna system 5' from the outside environment and encapsulate the radiators 10 within.

Figure 11A:
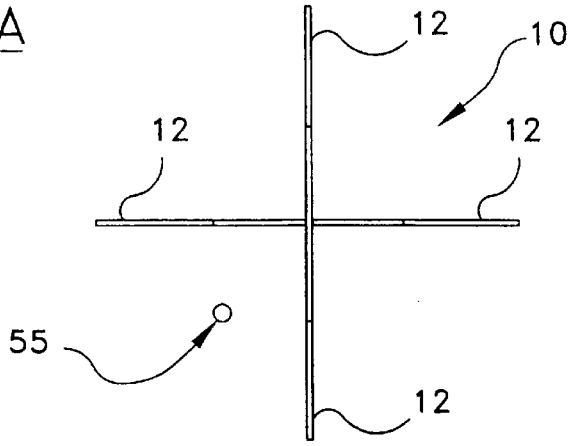
FIGS. 11A, 11B, and 11C are respective top plan, side elevational and perspective views of a feedback post placed adjacent to a radiating element in accordance with another exemplary embodiment of the present invention.
Figure 11B:
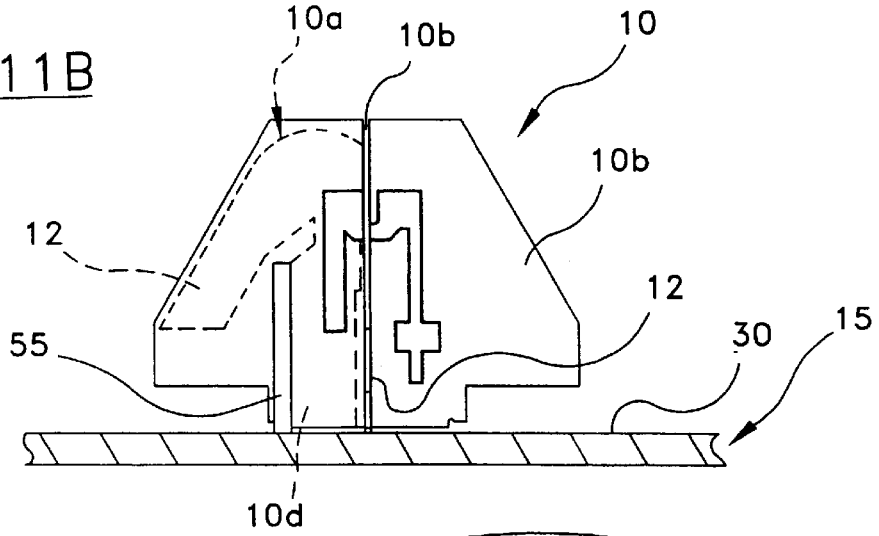
Figure 11C:
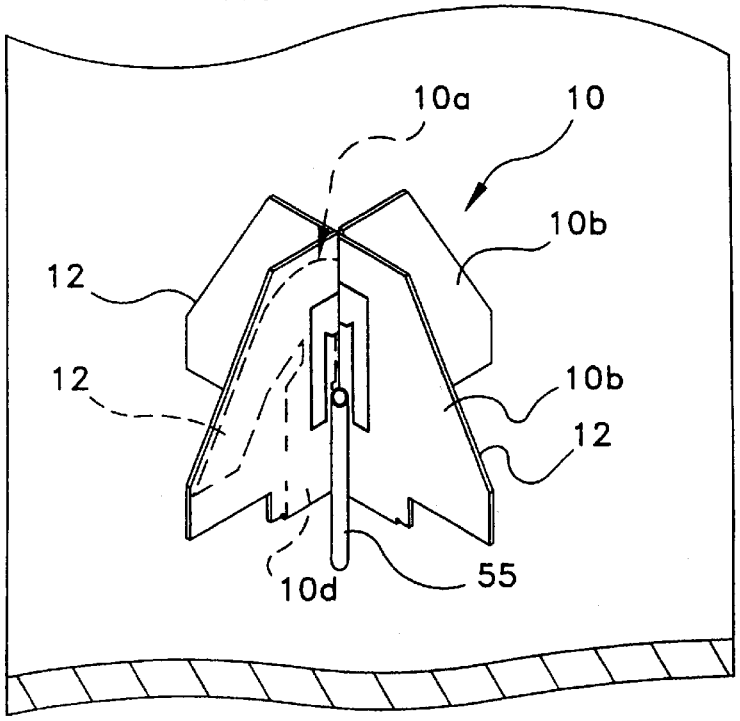

Referring now to FIGS. 11A–11C, another alternative exemplary embodiment of the present invention is illustrated, wherein a feedback post 55 can be used to couple a feedback signal to the radiators 10. FIGS. 11A–11C specifically show the placement of the feedback post 55 relative to the dielectric substrates 10*b* of the radiators 10. The feedback post 55 is preferably mounted adjacent to and between the crossly-oriented dielectric substrates 10*b*, preferably facing the transmission line 10*d* for each of the radiators. Thus, the arms 12 of the dipoles 10*a* are positioned on the opposite faces of the dielectric substrates 10*b*, thereby placing the feedback post 55 in an operative position to couple signals through the dielectric substrate 10*b* to the dipoles 10*a*. However, the specific position to locate the feedback post 55 is ultimately determined by the particular application being undertaken and the specific frequencies involved as well as the continual monitoring during the adjusting process. The feedback post 55 is preferably formed from a material having conductive properties. In addressing the specific dimensions of the feedback post 55, it is preferable that the feedback post 55 be 3/10 wavelength ($3\gamma/10$) in height. The diameter of the exemplary embodiment of the feedback post 55, as illustrated in FIG. 11A–11C, is 1/48-wavelength. As to the specific positioning of the feedback post 55, various positions may be utilized. For example, the feedback post 55 is shown in the exemplary embodiment of FIGS. 11A–11C to be positioned between the arms 12 of the dipoles 10*a* at a distance of ⅛ wavelengths from each arm 12. It is further noted that differing sizes may be utilized for the feedback post 55 as is dictated by the particular application being undertaken and the specific frequencies that are involved.

The feedback post 55 is preferably mounted to the ground plane structure 30 of the antenna system 5 in such a manner as to be electrically decoupled therefrom. It is further preferable that the feedback post 55 be mounted to the ground plane structure 30 in such a manner that it is capable of withstanding the vibrational and shock forces commonly experienced by the antenna system 5 during normal use. The final orientation of the feedback post 55 is determined by empirically adjusting the position of the feedback post 55 relative to the radiators 10, adjacent the face of the dielectric substrates 10*b* containing the feed lines 10*d*, until a maximum desired isolation is achieved by that particular feedback post 55. The final positioning of the feedback posts 55 will be dictated by the particular antenna application at hand and the frequencies involved. If the isolation achieved by the first implemented feedback post 55 is not sufficient, then additional feedback posts 55 are added one at a time to the antenna system 5 until the degree of desired isolation is finally achieved, as similarly described above in the method 800. Once the desired degree of isolation is achieved, a series of baseline measurements are repeated to ensure that no performance degradation has occurred in regards to VSWR and gain-related patterns. Far field measurements of the antenna system 5 can be taken and recorded to verify gain and polarization performance.

Figure 12A:
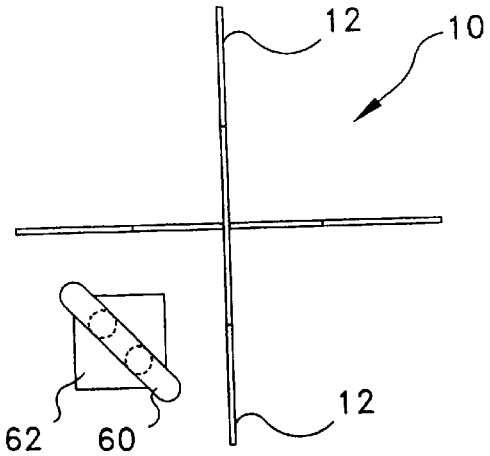
FIGS. 12A, 12B, and 12C are respective top plan, side elevational and perspective views of a radiating element constructed in accordance with another exemplary embodiment of the present invention.
Figure 12B:
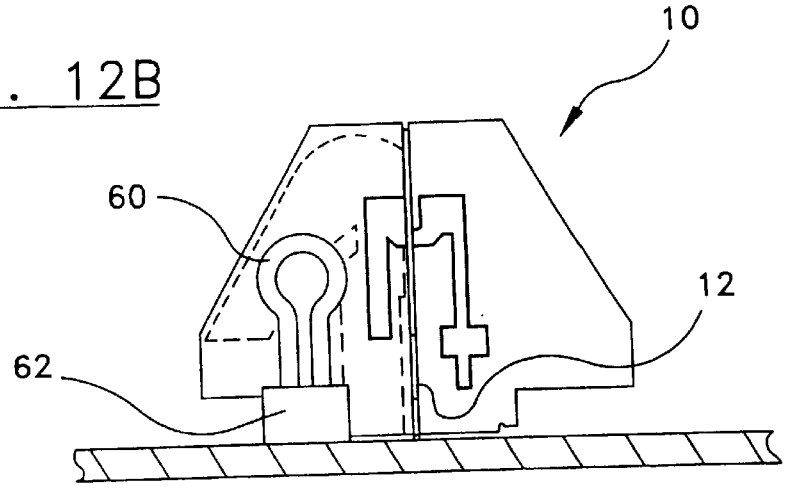
Figure 12C:
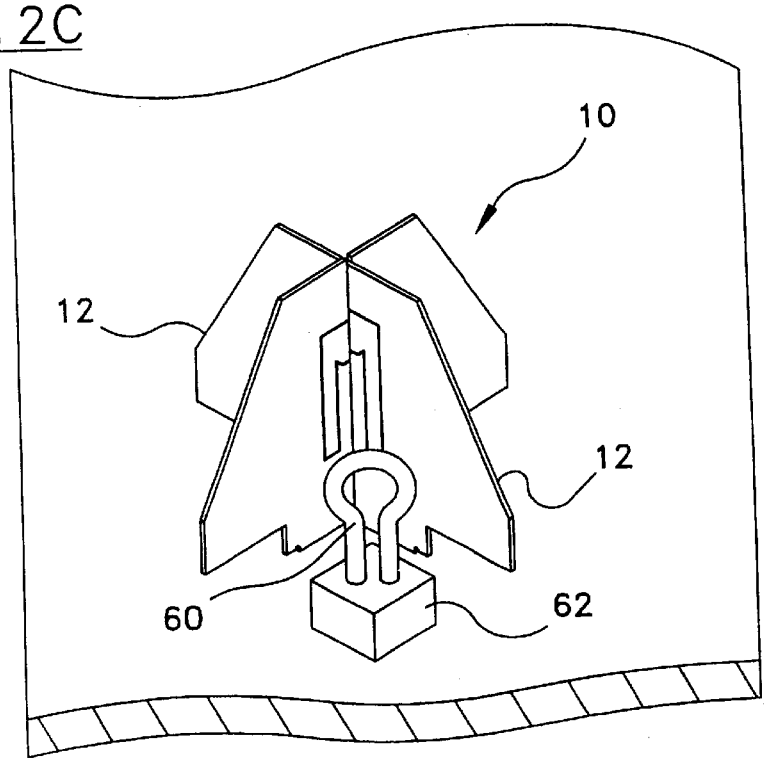

Referring now to FIGS. 12A–12C, another alternative exemplary embodiment of the present invention is illustrated utilizing a feedback wire 60 to provide a feedback signal to the radiators 10. It is preferable that the feedback wire 60 be mounted on a foam block 62 to provide sufficient decoupling of the feedback wire 60 from the ground plane structure 30. It can be seen in FIGS. 12A–12C that the feedback wire 60 is in the form of a loop. The loop of the feedback wire 60 is preferably sized to promote resonance at the frequency of the transmitted electromagnetic signals. However, various other configurations of the feedback wire 60 can be used to effectuate the necessary generation and coupling of a feedback signal to the radiators 10. In the exemplary embodiment shown in FIGS. 12A–12C, the feedback wire 60 is positioned between the arms 12 of the dipoles 10*a* such that the center of the loop is at a distance of ⅛ wavelengths from each arm 12. As for the loop, for example, the radius may be equal to 1/10 wavelengths, the height of the loop may be ¼ wavelengths and the diameter of the wire may be 1/48 wavelengths. The final orientation and configuration of the feedback wire 60 is ultimately determined by empirically adjusting the position of the feedback wire 60 relative to the radiators 10 until a maximum desired isolation is achieved by that particular feedback wire 60 in a manner similar to the method 800 illustrated in FIGS. 8A–8C.

Independent of the final positioning, the feedback wire 60 generally retains a position adjacent the faces of the dielectric substrates 10*b* that contain the feed lines 10*d*. For example, the height of the feedback wire 60 can be adjusted with respect to the ground plane structure 30 and the spacing of the feedback wire 60 away from the radiators 10 can be varied. The antenna system 5 can be monitored for its isolation while the feedback wires 60 are positioned, one at a time, among the radiators 10 until the antenna system 5 achieves the desired degree of isolation. After the desired degree of isolation is achieved, a series of baseline measurements can be repeated again to ensure that no performance degradation has occurred in regards to VSWR and gain-related patterns. Provided no performance degradation has occurred, the orientations of the individual feedback wires 60 are then made permanent and the antenna system 5 can be measured at the far field range for its gain and polarization performance.

Figure 13:
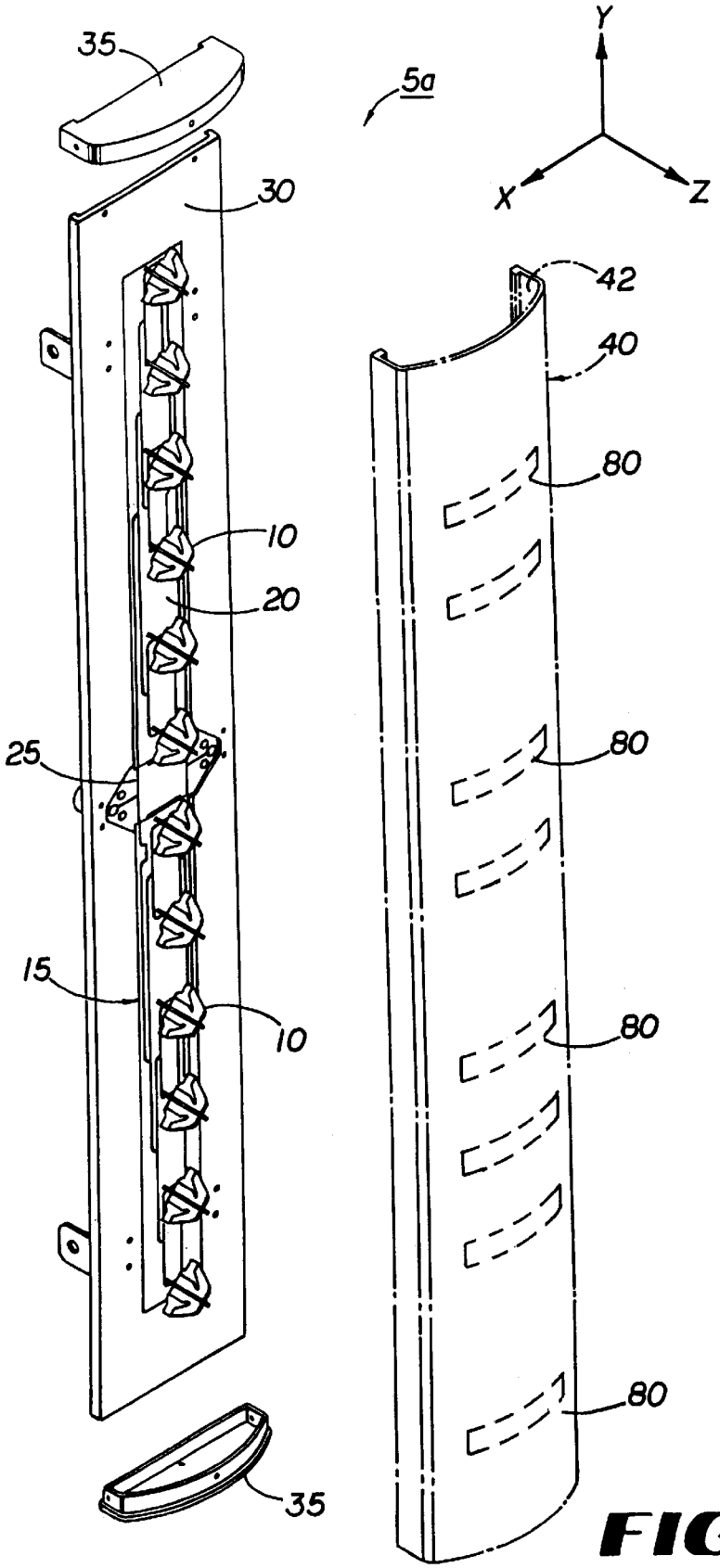
FIG. 13 is an exploded assembly view of a dual polarized antenna system, including a distribution network, radiating elements, a radome (shown in phantom view) and a non-symmetrical feedback element configuration, constructed in accordance with an exemplary alternative embodiment of the present invention.

In referring now to FIG. 13, another alternative exemplary embodiment of the present invention is illustrated utilizing a feedback element 80 to provide a feedback signal to the radiators 10. In antenna system 5*a*, the feedback element 80 is similar in construction to the feedback element 46 as used in antenna system 5. However, in this instance, the final configuration pattern of the feedback elements 80 along the radome 40 is non-symmetrical and unevenly spaced. More particularly, feedback elements 80 are arranged such that the spacing between each feedback element 80 is not consistent from one feedback element 80 to the next. Further, the pattern formed by the feedback elements 80 is non-symmetrical with respect to the power divider network 25 positioned in the middle of the array of radiators 10. In the exemplary embodiment of FIG. 13, the feedback elements 80 are spaced apart at increments corresponding to the spacing of the radiators 10, have a width of less than or equal to ⅛ wavelengths and a length of ½ wavelengths.

The pattern of the feedback elements 80 can be seen to include two spaced apart pairs of feedback elements 80 positioned at one end of the radome 40 and a group of three feedback elements 80 spaced apart from a single feedback element 80 positioned at the other end of the radome 40. Thus, a feedback element 80 is not positioned between each and every radiator 10 as was previously illustrated in FIGS. 1 and 3B for antenna system 5. This non-symmetrical pattern is equally successful in generating the requisite feedback signal needed to improve the overall port-to-port isolation of the antenna system 5*a*. It is further noted that the actual pattern of feedback elements 80 that results can vary from antenna to antenna as well as from the exemplary pattern illustrated in FIG. 13. Generally, it is the specific application at hand that dictates the resulting spacing and pattern of the feedback elements 80.

Figure 14:
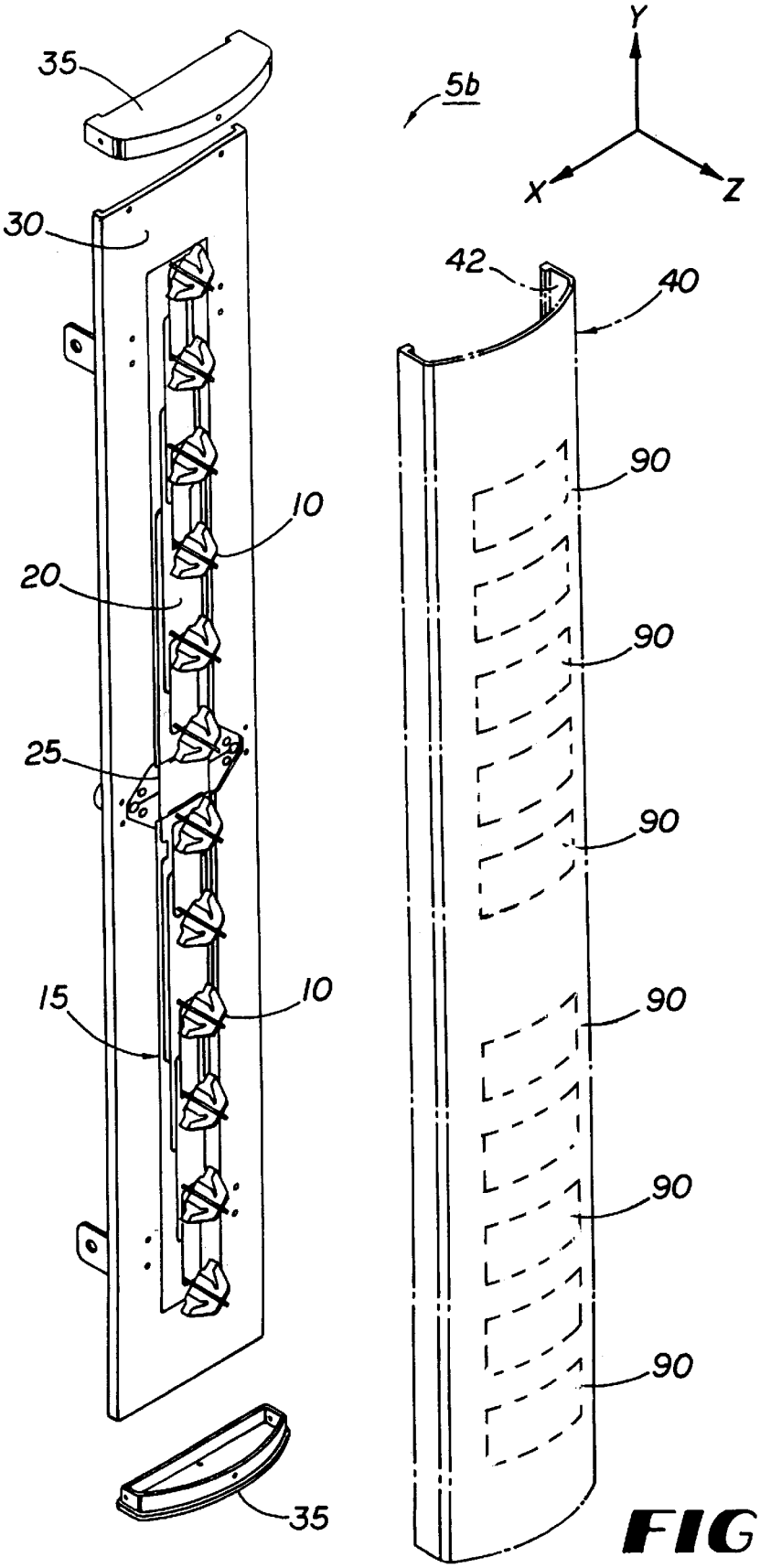
FIG. 14 is another exploded assembly view of a dual polarized antenna system, including a distribution network, radiating elements, a radome (shown in phantom view) and a wide strip feedback element configuration, constructed in accordance with an exemplary alternative embodiment of the present invention.

Similar to the alternative exemplary embodiment in FIG. 13, FIG. 14 illustrates another alternative exemplary embodiment of an antenna system 5*b* utilizing a feedback element 90 in the form of a wide conductive strip placed on the interior surface 42 of the radome 40. In this instance, for example, the wide conductive strip of feedback element 90 shown in FIG. 14 is in the shape of a rectangle sized such that its width is less than or equal to ⅛ wavelengths and its length is ½ wavelengths. For example, the feedback elements 90 illustrated in FIG. 14 have a length of Feedback elements 90 can be seen to be configured in a consistently spaced and symmetrical pattern similar to the configuration of feedback elements 46 as illustrated in FIGS. 1 and 3B for antenna system 5. However, it is noted that the feedback elements 90 can be placed in various other patterns having various other spacings and various other patterns, including non-symmetrical patterns, on the radome 40 as may be dictated by the specific application at hand. Feedback element 90 is readily incorporated into the antenna system 5*b* in accordance with method 800 as described above.

Figure 15:
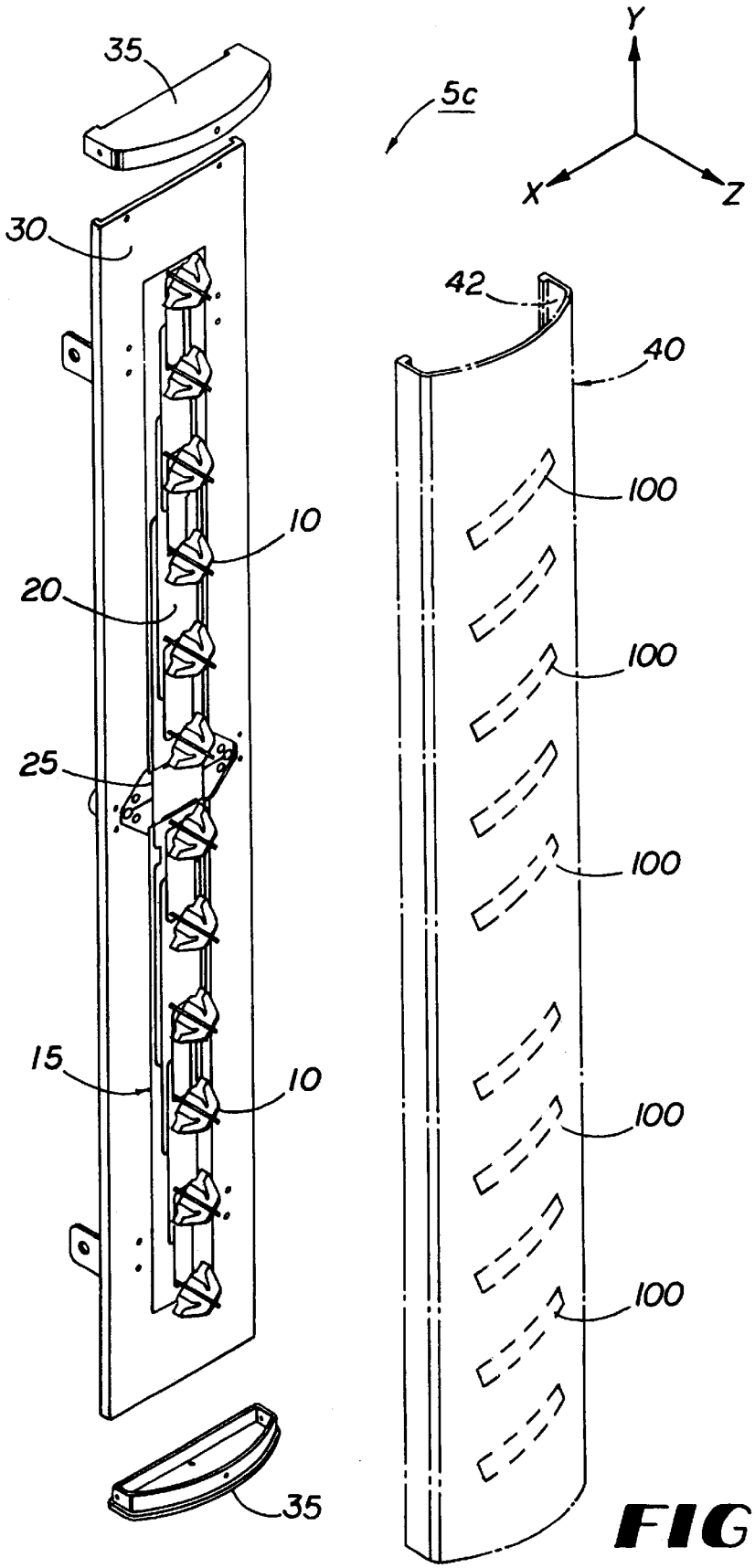
FIG. 15 is another exploded assembly view of a dual polarized antenna system, including a distribution network, radiating elements, a radome (shown in phantom view) and a tilted (angled) feedback element configuration, constructed in accordance with an exemplary alternative embodiment of the present invention.

In referring now to FIG. 15, another alternative exemplary embodiment of the present invention is illustrated utilizing a feedback element 100 to provide a feedback signal to the radiators 10. In antenna system 5*c*, feedback element 100 is in the form of a tilted (angled) conductive strip whereby a rotational aspect is introduced into the feedback signal. As illustrated in FIG. 15, the feedback elements 100 are arranged on the interior surface 42 of the radome 40 in a symmetrical pattern with respect to the power divider network 25 positioned in the middle of the array of radiators 10. For example, feedback elements 100 may be sized having a length of ½ wavelengths and a width of ⅛ wavelengths. The orientation angle illustrated in FIG. 15 may, for example, be set at less than or equal to 22.5 degrees from the perpendicular axis of the radome 40 and spaced at distances corresponding to the spacing of the radiators 10. The feedback elements 100 can also be seen to be evenly spaced from one another. It is noted, however, that feedback elements 100 can be configured with various other spacings and in various other patterns, including non-symmetrical patterns as, for example, illustrated in FIG. 13 or where the tilt (angle) varies among the feedback elements 100. Further, feedback element 100 is readily incorporated into the antenna system 5*c* in accordance with method 800 as described above. In fitting the antenna system 5*c* with the feedback elements 100, the final resulting spacing and pattern will generally be dictated by the specific application at hand and the amount of feedback signal required.

Figure 16:
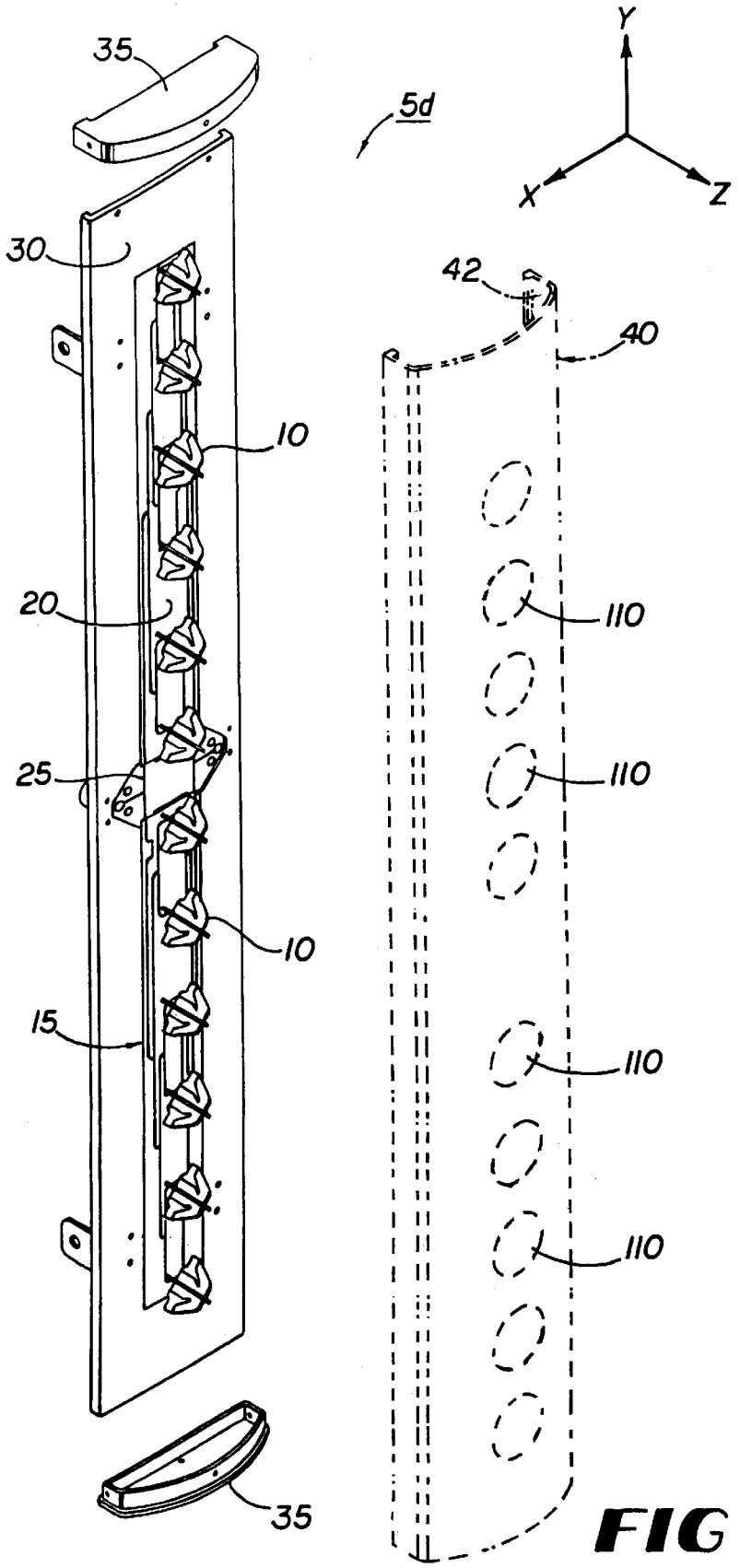
FIG. 16 is another exploded assembly view of a dual polarized antenna system, including a distribution network, radiating elements, a radome (shown in phantom view) and a circular patch feedback element configuration, constructed in accordance with an exemplary alternative embodiment of the present invention.

In referring now to FIG. 16, another alternative exemplary embodiment of the present invention is illustrated utilizing a feedback element 110 to provide a feedback signal to the radiators 10. In antenna system 5*d*, feedback element 110 is in the form of a circular conductive patch. For example, the circular patches illustrated in FIG. 16 may be sized having a radius of ½π wavelengths and spaced apart at a distance corresponding to the spacing of the radiators 10. The feedback elements 110 can be seen to be spaced apart at even distances from one another and configured in a symmetrical pattern. It is noted, however, that feedback elements 110 can be configured with various other spacings and in various other patterns, including non-symmetrical patterns as was, for example, previously illustrated in FIG. 13 for antenna system 5*a*. Feedback element 110 is readily incorporated into antenna system 5*d* in accordance with method 800 as described above. In short, when fitting the antenna system 5*d* with the feedback elements 110, the resulting spacing and pattern will generally be dictated by the specific application at hand and the amount of feedback signal required.

Figure 17:
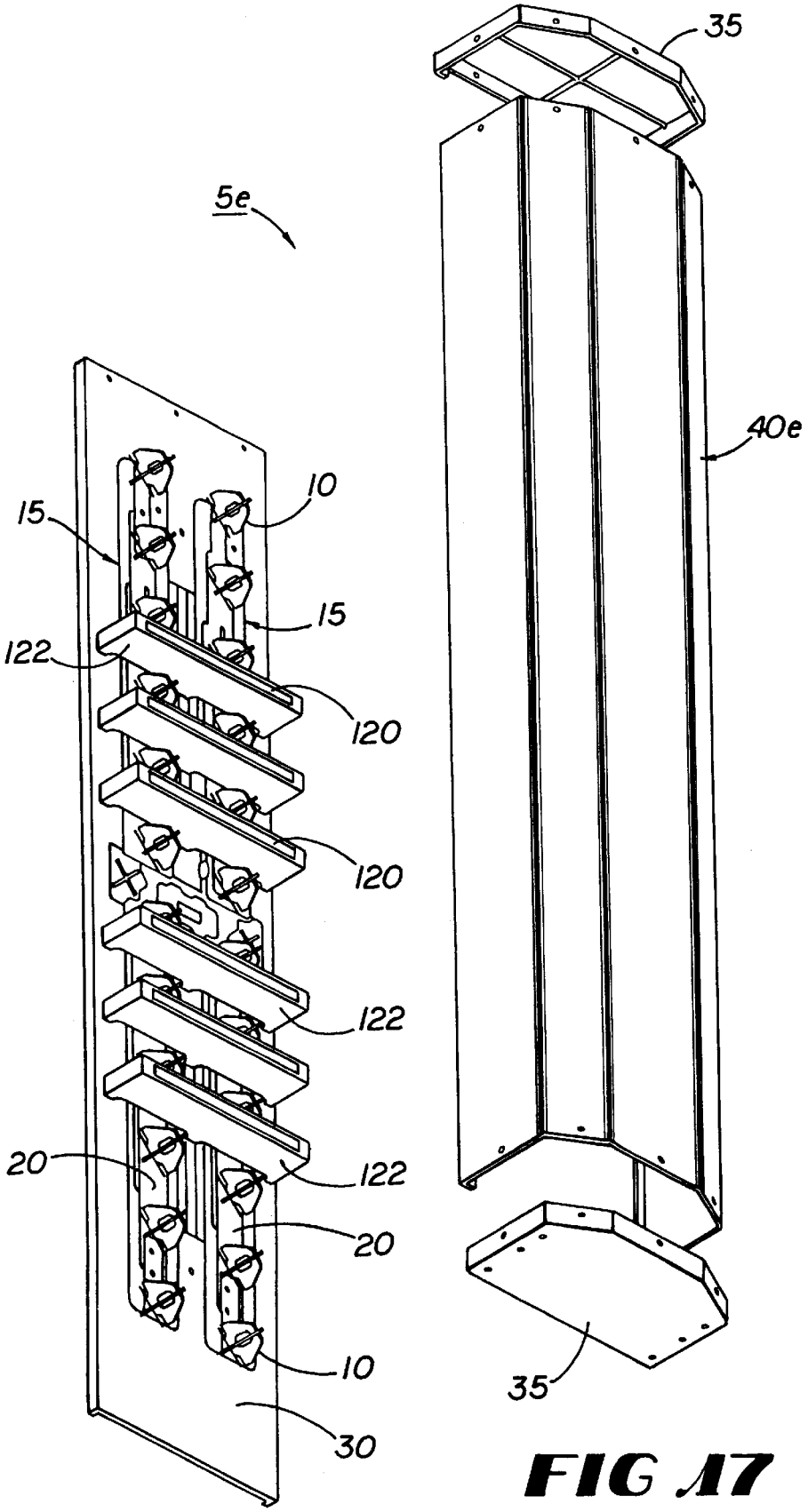
FIG. 17 is an exploded assembly view of a dual polarized antenna system formed from two arrays of dual polarized radiators, each array including a distribution network, a plurality of radiating elements, a radome (shown in phantom view) and a feedback element configuration formed from a conductive strip positioned on a foam bar, the antenna system constructed in accordance with an exemplary alternative embodiment of the present invention.

In referring now to FIG. 17, another alternative exemplary embodiment of the present invention is illustrated utilizing a feedback element 120 to provide a feedback signal to the radiators 10. In the alternative exemplary embodiment illustrated in FIG. 17, the feedback elements 120 can be seen as applied to an antenna system 5*e* formed from two arrays of dual polarized radiators 10. In addition, a radome 40*e* is utilized that is wider from the radome 40 as used in the other alternative exemplary embodiments shown in FIGS. 1, 3A–C and 13–16. In this antenna system 5*e*, feedback element 120 is in the form of a conductive strip placed on top of a foam bar 122 positioned between the radiators 10. Feedback elements 120 are configured as such in order to maintain a proper and consistent distance from the radiators 10. The use of feedback elements 120 formed in this manner also allows the feedback elements 120 to be positioned below the radome 40*e* and thereby alleviate any distance variances due to the pronounced curvature in radome 40*e* which would cause the ends of feedback elements 120 to be closer to the radiators 10 than the middle portions of the feedback elements 120.

In this alternative exemplary embodiment illustrated in FIG. 17, the feedback elements 120 are typically longer in length than those previously illustrated in FIGS. 1, 3A–C and 13–16. For example, feedback elements 120 are generally longer than ½ wavelength. Those skilled in the art can readily determine what specific lengths are required to produce the desired resonance at the operation frequencies of the application at hand. In the exemplary embodiment of FIG. 17, for example, the feedback elements 120 have a length of one (1) wavelength, a width of less than or equal to ⅛ wavelengths and are spaced apart at a distance corresponding to the spacing of the radiators 10. Feedback elements 120 and foam bars 122 are likewise readily incorporated into the antenna system 5*e* in accordance with method 800 as described above. However, with this alternative exemplary embodiment, method 800 varies slightly from its earlier description. That is, the adjustment steps in method 800 now involve the adjustment of feedback elements 120 on foam bars 122 positioned on the distribution network 15 and the ground plane structure 30 of the antenna system 5*e* rather than feedback elements 46 being placed on radome sections 48 and then on a single-piece radome 40 as in the exemplary embodiment of FIG. 1. The feedback element 120 can be placed in varying patterns and heights extending from the distribution network 15, and the ground plane structure 30 with equal success as may be dictated by the specific application at hand and the amount of feedback signal required.

Figure 18:
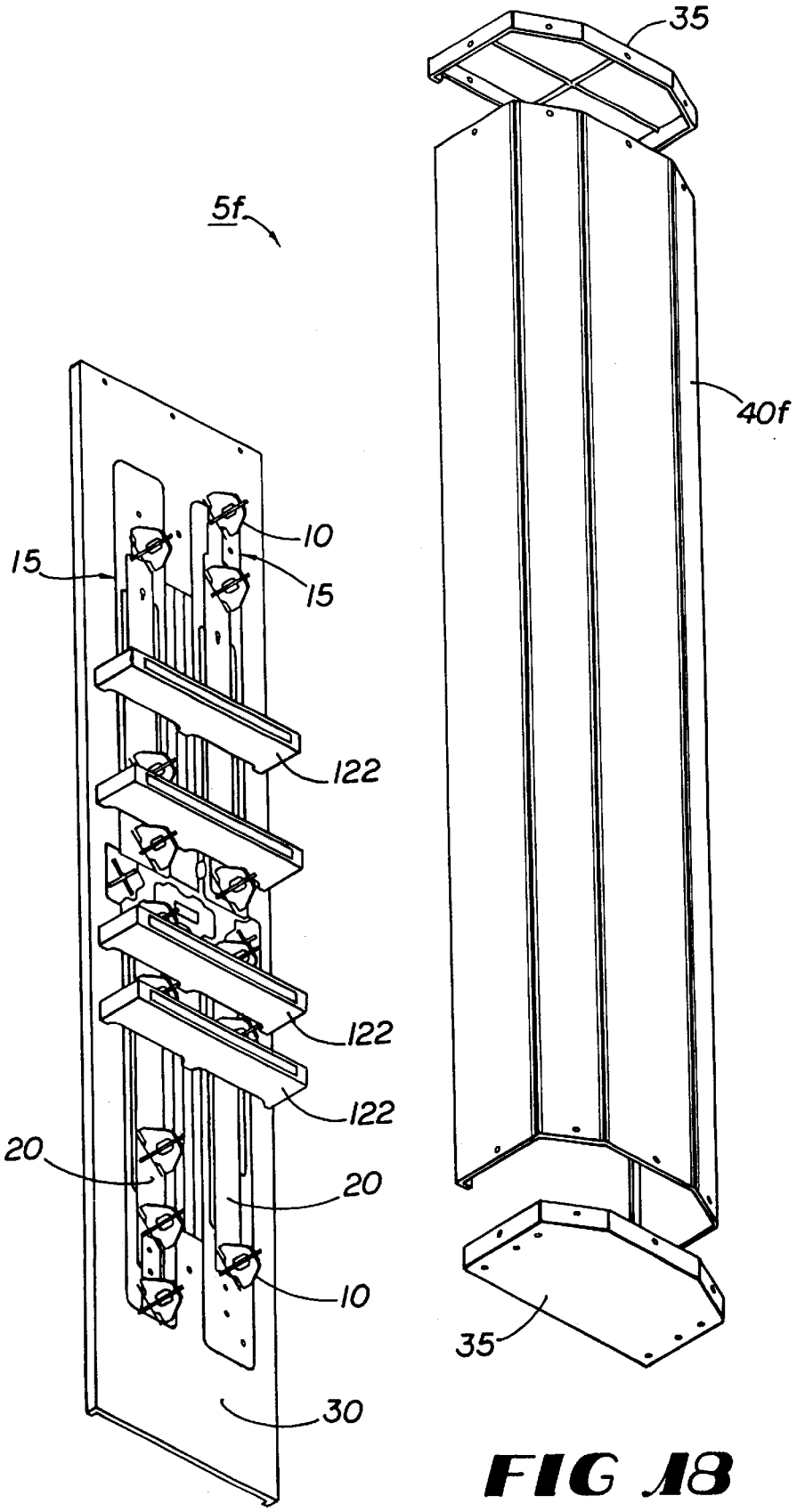
FIG. 18 is an exploded assembly view of a dual polarized antenna system formed from two arrays of dual polarized radiators, each array including a distribution network, a plurality of radiating elements positioned at varying distances from each other within the array, a radome (shown in phantom view) and a feedback element configuration formed from a conductive strip positioned on a foam bar, the antenna system constructed in accordance with an exemplary alternative embodiment of the present invention.

In referring now to FIG. 18, another alternative exemplary embodiment of the present invention is illustrated utilizing feedback elements 122 to provide a feedback signal to the radiators 10. In this alternative exemplary embodiment, however, an antenna system 5*f* is shown having the feedback elements 122 positioned between unevenly spaced apart radiators 10. Similar to antenna system 5*e*, antenna system 5*f* in FIG. 18 is comprised of two arrays of dual polarized radiators 10 that are aligned in parallel with each other. In particular, the two arrays of radiators 10 can be seen to have individual radiators 10 spaced apart such that two radiators 10 are positioned on either side of and proximal to each array's midpoint. The arrays further include a group of radiators 10 positioned at one end of each array along with a single radiator 10 positioned a significant distance away from the group of radiators 10 at the other end of each array. The two arrays of radiators 10 are arranged on the ground plane structure 30 in a parallel manner such that the single radiator 10 at one end of one array is positioned next to the group of radiators 10 positioned at an end of the other array.

In addition, antenna system 5*f* also includes a similar radome 40*f* that is wider than the radome 40 used in the exemplary embodiment illustrated in FIG. 1. The radome 40*f* is designed to facilitate encompassing the ground plane structure 30 and the two arrays of radiators 10. The feedback elements 122 are positioned on and extending over the distribution network 15 and the ground plane structure 30 such that the unevenly spaced apart radiators 10 will couple transmitted electromagnetic signals into the feedback elements 122 at differing amounts depending upon the distance of the feedback elements 122 from the radiators 10. Thus, the radiators 10 that form the array do not have to be aligned in an evenly spaced configuration for the feedback elements 122 to be successfully incorporated into the antenna system 5*f*. The feedback elements 122 as illustrated in the exemplary embodiment of FIG. 18, for example, are sized similar to feedback elements 120 in FIG. 17 having a length of one (1) wavelength, a width of less than or equal to ⅛ wavelengths and spacing corresponding to the spacing of the radiators 10.

In summary, the present invention generally comprises a feedback system that is incorporated into an antenna system and provides for the electrical coupling of a feedback signal to the radiating elements to improve the isolation characteristics of the antenna system. The feedback elements are operatively positioned within the antenna system relative to the radiating elements so to achieve the desired amount of coupling into the radiating elements. With the correct amount of coupling, an appropriate feedback signal having the correct phase and amplitude will be produced which, in turn, will result in the desired amount of isolation being achieved within the antenna system. The feedback signal, for example, can be generated by feedback elements such as conductive strips placed on the interior surface of the radome. The conductive strips are placed such that, when the radome is placed on the antenna system, the conductive strips are in an operative position relative to the radiating elements. The use of a conductive strip for the feedback element provides an effective means for generating the desired feedback signal for the antenna system. Those skilled in the art will understand that the feedback system of the present invention can readily accept other forms of feedback elements with equal success in achieving an improved isolation characteristic for the antenna system (i.e., feedback posts, feedback wires).

It is important to further note that, although the embodiments of the present invention have been described in detail with particularity to several different feedback mechanisms in conjunction with a dual polarized radiator antenna, the present invention can be equally applied to various other types of antennas. For example, the present invention is equally applicable to patch antennas wherein patches on dielectric substrate are used as the radiating elements.

Alternative embodiments will become apparent to those skilled in the art to which the present invention pertains without departing from its spirit and scope. Thus, although this invention has been described in exemplary form with a certain degree of particularity, it should be understood that the present disclosure has been made only by way of example and that numerous changes in the details of construction and the combination and arrangement of parts may be resorted to without departing from the spirit and scope of the invention. Accordingly, the scope of the present invention is defined by the appended claims rather than the foregoing description.

What is claimed is:

1. An antenna system for transmitting and receiving electromagnetic signals, the antenna system comprising:

a plurality of radiators;

a distribution network, coupled to each of the radiators, for communicating the electromagnetic signals from and to each of the radiators; and a feedback system coupled relative to the distribution network for generating a feedback signal to at least one of the radiators, the feedback system including at least one feedback element disposed offset relative to a pair of radiators within the plurality of radiators for generating the feedback signal in response to receiving the electromagnetic signals transmitted by said pair of radiators, the feedback signal operative to cancel a leakage signal present at the distribution network and thereby increase the port to port isolation of the antenna system.

2. The antenna system recited in claim 1 further comprising a radome coupled relative to the distribution network for protecting the radiators and the distribution network from exposure to the operating environment of the antenna system, wherein the feedback element is coupled to the radome for generating the feedback signal in response to receiving the electromagnetic signals transmitted by the radiators.

3. The antenna system recited in claim 2, wherein each feedback element is connected to an interior surface of the radome and positioned proximate to at least one of the radiators.

4. The antenna system recited in claim 2, wherein the feedback element comprises an electrically conductive material having a length sufficient for resonating at a frequency of the transmitted electromagnetic signals.

5. The antenna system recited in claim 4, wherein the feedback element is sized having a width equal to a maximum of ⅛ wavelengths.

6. The antenna system recited in claim 2, wherein the feedback element comprises an electrically conductive material sized sufficiently for resonating at a frequency of the transmitted electromagnetic signals.

7. The antenna system recited in 6, wherein the feedback element is in the form of a circular patch.

8. The antenna system recited in claim 1, wherein the feedback element is in the form of a conductive strip having a length of ½ wavelength.

9. The antenna system recited in claim 1, wherein the feedback element is in the form of a conductive strip positioned on a nonconductive material, the conductive strip thereby being electrically isolated from the distribution network.

10. The antenna system recited in claim 1, wherein the feedback element is capacitively coupled to at least one of the radiators, for generating the feedback signal in response to receiving the electromagnetic signals transmitted by the radiators.

11. The antenna system recited in claim 10, wherein the feedback element comprises an electrically conductive material having a length sufficient for resonating at the frequency of the transmitted electromagnetic signals.

12. The antenna system recited in claim 11, wherein the feedback element has a length of ⅛ wavelength.

13. The antenna system recited in claim 11, wherein the feedback element has a length of 3/10 wavelength.

14. The antenna system recited in claim 10, wherein the feedback element is capacitively coupled to each radiator at a position on the radiator where the voltage of the transmitted electromagnetic signals is at a maximum level, thereby promoting maximum electrical coupling of the transmitted electromagnetic signals to the feedback element.

15. The antenna system recited in claim 1, wherein the feedback system comprises at least one feedback element configured so to produce a rotational characteristic within the feedback signal.

16. An antenna system for transmitting and receiving electromagnetic signals, the antenna system comprising:

a plurality of radiators;

a distribution network, coupled to each of the radiators, for communicating the electromagnetic signals from and to each of the radiators; and a feedback system coupled relative to the distribution network for generating a feedback signal to at least one of the radiators, the feedback signal operative to cancel a leakage signal present at the distribution network and thereby increase the port to port isolation of the antenna system, said feedback system comprises at least one feedback post, coupled to the distribution network and positioned proximate to at least one of the radiators, for generating the feedback signal in response to receiving the electromagnetic signals transmitted by the radiators.

17. The antenna system recited in claim 16, wherein each feedback post is positioned between the radiators and comprises electrically conductive material having a length sufficient for resonating at the frequency of the transmitted electromagnetic signals.

18. An antenna system for transmitting and receiving electromagnetic signals, the antenna system comprising:

a plurality of radiators;

a distribution network, coupled to each of the radiators, for communicating the electromagnetic signals from and to each of the radiators; and a feedback system coupled relative to the distribution network for generating a feedback signal to at least one of the radiators, the feedback signal operative to cancel a leakage signal present at the distribution network and thereby increase the port to port isolation of the antenna system, the feedback system comprises at least one feedback wire, coupled relative to the distribution network and positioned so to electrically cooperate with at least one of the radiators, for generating the feedback signal in response to receiving the electromagnetic signals transmitted by the radiators.

19. The antenna system recited in claim 18, wherein the feedback wire and the distribution network are separated by a nonconductive material thereby positioning the feedback wire above a surface of the distribution network.

20. The antenna system recited in claim 19, wherein the feedback wire comprises a loop sized to promote resonance at the frequency of the transmitted electromagnetic signals.

21. An antenna system for transmitting and receiving electromagnetic signals, the antenna system comprising:

a plurality of radiators;

a distribution network, coupled to each of the radiators, for communicating the electromagnetic signals from and to each of the radiators;

a feedback system coupled relative to the distribution network for generating a feedback signal to at least one of the radiators, the feedback signal operative to cancel a leakage signal present at the distribution network and thereby increase the port to port isolation of the antenna system; and a radome coupled relative to the distribution network, and wherein the feedback system comprises a plurality of feedback elements coupled to the radome and configured such that the distances between each of the plurality of feedback elements is uneven.

22. An antenna system for transmitting and receiving electromagnetic signals, the antenna system comprising:

a plurality of radiators;

a distribution network, coupled to each of the radiators, for communicating the electromagnetic signals from and to each of the radiators;

a feedback system coupled relative to the distribution network for generating a feedback signal to at least one of the radiators, the feedback signal operative to cancel a leakage signal present at the distribution network and thereby increase the port to port isolation of the antenna system; and a radome coupled relative to the distribution network and wherein the feedback system comprises a plurality of feedback elements coupled to the radome and configured in a nonsymmetrical pattern with respect to the plurality of radiators.

23. A method for adjusting a port to port isolation characteristic of an antenna system, comprising the steps of:

(a) performing baseline measurements on the antenna system to generate an initial set of selected performance parameters for the antenna system;

(b) presenting a feedback signal having an amplitude characteristic and a phase characteristic to the antenna system, the feedback signal operative to cancel at least a portion of a leakage signal at an output port of the antenna system;

(c) monitoring the port to port isolation characteristic of the antenna system while presenting the feedback signal to the antenna system; and (d) adjusting the feedback signal by varying at least one of the amplitude characteristic and the phase characteristic of the feedback signal until the port to port isolation characteristic is set to a desired isolation level.

24. The method recited in claim 23 further comprising the steps of:

(e) responsive to adjusting the feedback signal, performing the baseline measurements on the antenna system to generate a second set of selected performance parameters for the antenna system; and (f) comparing the initial set of selected performance characteristics to the second set of selected performance characteristics to determine if the performance of the antenna system has been degraded by presenting the feedback signal to the antenna system.

25. The method recited in claim 24 further comprising the step of (g) repeating steps (b)–(f) until the desired isolation level is achieved without degrading the performance of the antenna system.

26. The method recited in claim 23, wherein the step of presenting the feedback signal to the antenna system comprises the step of:

placing a feedback element proximate to one of a plurality of radiators for the antenna system so that the feedback element can respond to the radiator transmitting an electromagnetic signal by generating the feedback signal.

27. The method recited in claim 26, wherein the step of adjusting the feedback signal comprises adjusting the position of the feedback element relative to the radiator to support electrical coupling of the feedback signal between the feedback element and the radiator.

28. The method recited in claim 23, wherein the step of presenting the feedback signal to the antenna system comprises the steps of:

placing a feedback element on a section of a radome for the antenna system; and placing the radome section proximate to one of a plurality of radiators of the antenna system so that the feedback element can respond to the radiator transmitting an electromagnetic signal by generating the feedback signal.

29. The method recited in claim 28, wherein the step of adjusting the feedback signal comprises:

(i) adjusting the position of the radome section relative to the particular radiator to support generation of the feedback signal by the feedback element and reception of the feedback signal by the radiator;

(ii) placing another one of the radome section proximate to another one of the radiators if the desired isolation level is not achieved for the antenna system; and (iii) adjusting the position of the other radome section until the desired isolation level is achieved by placement of the combination of the radome section and the other radome section proximate to the radiators of the antenna system.

30. The method recited in claim 29 further comprising the step of repeating steps (ii) and (iii) until the desired isolation level is achieved by placement of the combination of the radome section and the other radome section proximate to the radiators of the antenna system.

31. The method recited in claim 23, wherein the antenna system comprises a plurality of radiators extending adjacent to a ground plane, and the step of presenting the feedback signal to the antenna system comprises placing a conductive post proximate to one of the radiators and electrically isolated from the ground plane, the conductive post operative to resonate in response to an electromagnetic signal transmitted by one of the radiators and to generate the feedback signal for communication to the radiator.

32. The method recited in claim 23, wherein the antenna system comprises a plurality of radiators extending adjacent to a ground plane, and the step of presenting the feedback signal to the antenna system comprises placing a conductive loop proximate to one of the radiators and electrically isolated from the ground plane, the conductive loop operative to resonate in response to an electromagnetic signal transmitted by one of the radiators and to generate the feedback signal for communication to the radiator.

33. The method recited in claim 23, wherein the antenna system comprises a plurality of radiators extending adjacent to a ground plane, and the step of presenting the feedback signal to the antenna system comprises placing a conductive strip positioned on a nonconductive material proximate to at least one radiator, the conductive strip thereby being electrically isolated from the ground plane structure.

34. The method recited in claim 23, wherein the antenna system comprises a plurality of radiators, and the step of presenting the feedback signal to the antenna system comprises capacitively coupling a conductive strip to one of the radiators, the conductive strip operative to resonate in response to an electromagnetic signal transmitted by one of the radiators and to generate the feedback signal for communication to the radiator.

35. An antenna system for transmitting and receiving electromagnetic signals, the antenna system comprising:

a plurality of crossed-dipole radiators, each crossed-dipole including a first pair of arms and a second pair of arms;

a distribution network, coupled to each of the radiators, for communicating the electromagnetic signals from and to each of the radiators; and a feedback system coupled relative to the distribution network for generating a feedback signal to at least one of the radiators, the feedback system including at least one feed back element disposed between a first pair of arms and a second pair of arms of a respective crossed-dipole for generating the feedback signal in response to receiving the electromagnetic signals transmitted by the pairs of arms of the crossed-dipole radiator, the feedback signal operative to cancel a leakage signal present at the distribution network and thereby increase the port to port isolation of the antenna system.

* * * * *